US005583616A

United States Patent [19]

Yamamoto et al.

[11] Patent Number: 5,583,616

[45] Date of Patent: Dec. 10, 1996

[54] ELECTROPHOTOGRAPHIC APPARATUS WITH PRE-EXPOSURE CONTROLLED ACCORDING TO PHOTOCONDUCTOR THINNING

[75] Inventors: Takeo Yamamoto, Kawasaki; Takahiro Noguchi, Yokohama, both of Japan

[73] Assignee: Canon Kabushiki Kaisha, Tokyo, Japan

[21] Appl. No.: 529,856

[22] Filed: Sep. 18, 1995

[30] Foreign Application Priority Data

Sep. 16, 1994 [JP] Japan ..... 6-221609

[51] Int. Cl.[6] ..... G03G 15/00; G03G 21/00

[52] U.S. Cl. ..... 355/208; 355/210

[58] Field of Search ..... 355/208, 210, 355/211, 214, 216, 219

[56] References Cited

U.S. PATENT DOCUMENTS 4,288,514 9/1981 Kutsuwada et al. ..... 355/214 X 5,159,388 10/1992 Yoshiyama et al. ..... 355/208

FOREIGN PATENT DOCUMENTS 0568352 11/1993 European Pat. Off. .

*Primary Examiner*—Joan H. Pendegrass

*Attorney, Agent, or Firm*—Fitzpatrick, Cella, Harper & Scinto

[57] ABSTRACT

An electrophotographic apparatus includes an electrophotographic photosensitive member; a charging member contactable to the photosensitive member for charging the photosensitive member at a charging position; exposure means for exposing the photosensitive member to electrically discharging the photosensitive member, wherein when a region of the photosensitive member discharged by the exposure means is at the charging position, a voltage-current characteristic between the charging member and the photosensitive member is detected; changing means for changing an incident light quantity to the photosensitive member from the exposure means.

26 Claims, 18 Drawing Sheets

FIG. 3(a)
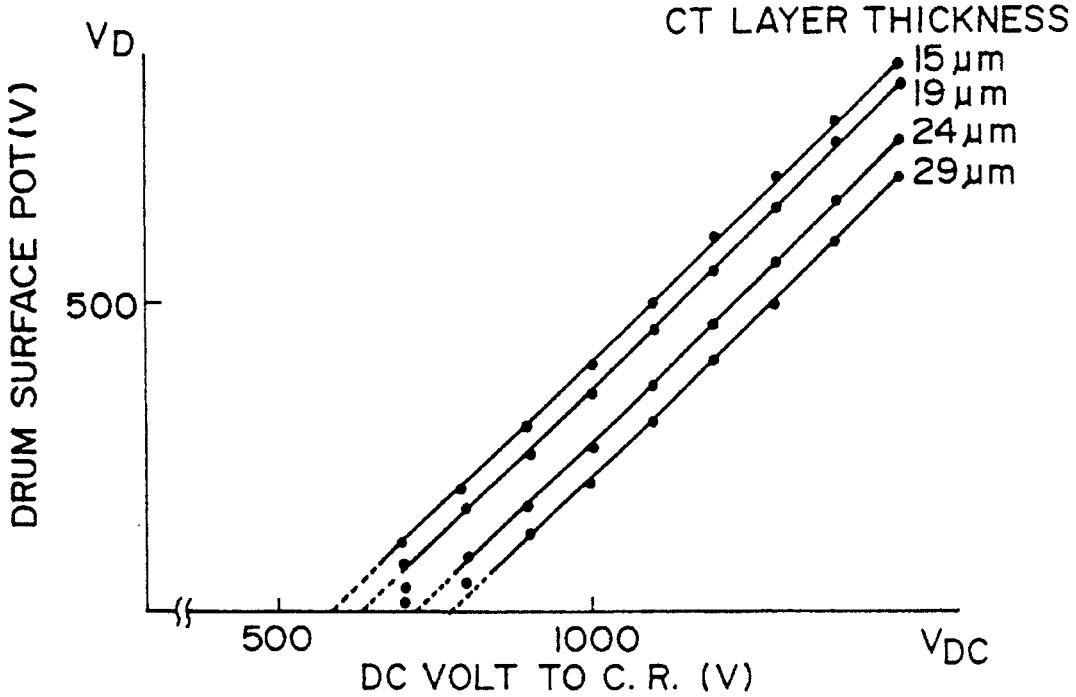
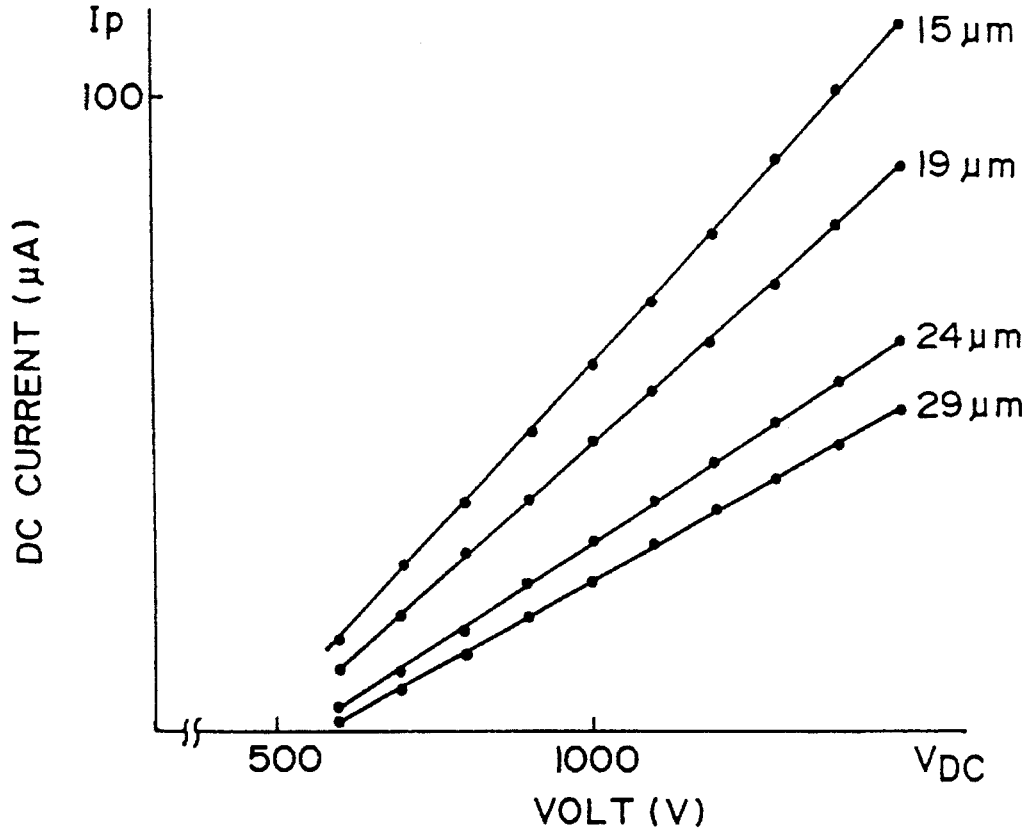
FIG. 3(b)

ELECTROPHOTOGRAPHIC APPARATUS WITH PRE-EXPOSURE CONTROLLED ACCORDING TO PHOTOCONDUCTOR THINNING

FIELD OF THE INVENTION AND RELATED ART

The present invention relates to an electrophotographic apparatus having a charging member contactable to a photosensitive member for charging the photosensitive member.

Conventionally, use of a contact charging device such as electroconductive roller, electroconductive brush contacted to a photosensitive member to charge it in an electrophotographic apparatus such as a copying machine or laser beam printer. A contact charging device has an advantage over a corona charging device provided with a shield and a wire in the voltage reduction of voltage source and small amount of production of ozone.

However, with long term use of the electrophotographic apparatus, the photosensitive layer is scraped by a cleaning blade contacted and the contact charging member, then the charge potential of the photosensitive member varies. This is a problem. For the purpose of prevention of the potential variation of the photosensitive member resulting from the decrease of the thickness of the photosensitive layer, EP-A568352 proposes that the decrease of the thickness of the photosensitive layer is predicted or estimated. In EP-A568352, for the purpose of the prediction of the thickness of the photosensitive layer, the current flowing through the charging member when a predetermined voltage is applied to the charging member contacted to the photosensitive member is detected. The current thus detected, increases with the decrease of the thickness of the photosensitive layer. Before the detection of the current flowing through the charging member, the photosensitive member is uniformly discharged by an exposure means in the form of a pre-exposure lamp. The voltage applied to the charging member during image formation is controlled on the basis of of the detected current so as to provide a desired potential of the photosensitive member.

However, due to a manufacturing lot difference of the photosensitive members, the average detected currents for the two photosensitive members having the same thicknesses of the photosensitive layers, in some cases. Namely, even if the thicknesses of the photosensitive layers are substantially uniform, the photosensitivity varies with the result of variation of the average detected current despite the same light quantity applied to the photosensitive member from the pre-exposure lamp. If the average detected current varies, the device predicts erroneously that the thicknesses of the photosensitive layers are different. The erroneous prediction results in excess and deficiency of the voltage applied to the charging member during the image formation, and therefore, improper potential of the photosensitive member and therefore improper image density. It would be considered that photosensitive member having relatively significantly different photosensitivities, are not incorporated in the device, but the reduced yield has then be to accepted.

SUMMARY OF THE INVENTION

Accordingly, it is a principal object of the present invention to provide an electrophotographic apparatus whose photosensitive member can be manufactured with high yield.

It is another object of the present invention to provide an electrophotographic apparatus capable of providing a proper image density.

It is a further object of the present invention to provide an electrophotographic apparatus capable of stabilizing a potential of a photosensitive member even after long term use.

These and other objects, features and advantages of the present invention will become more apparent upon a consideration of the following invention taken in conjunction with the accompanying drawings.

BRIEF DESCRIPTION OF THE DRAWINGS

FIGS. 3, (*a*) and (*b*) are charging property graphs.

DESCRIPTION OF THE PREFERRED EMBODIMENT

Embodiment 1

Figure 1:
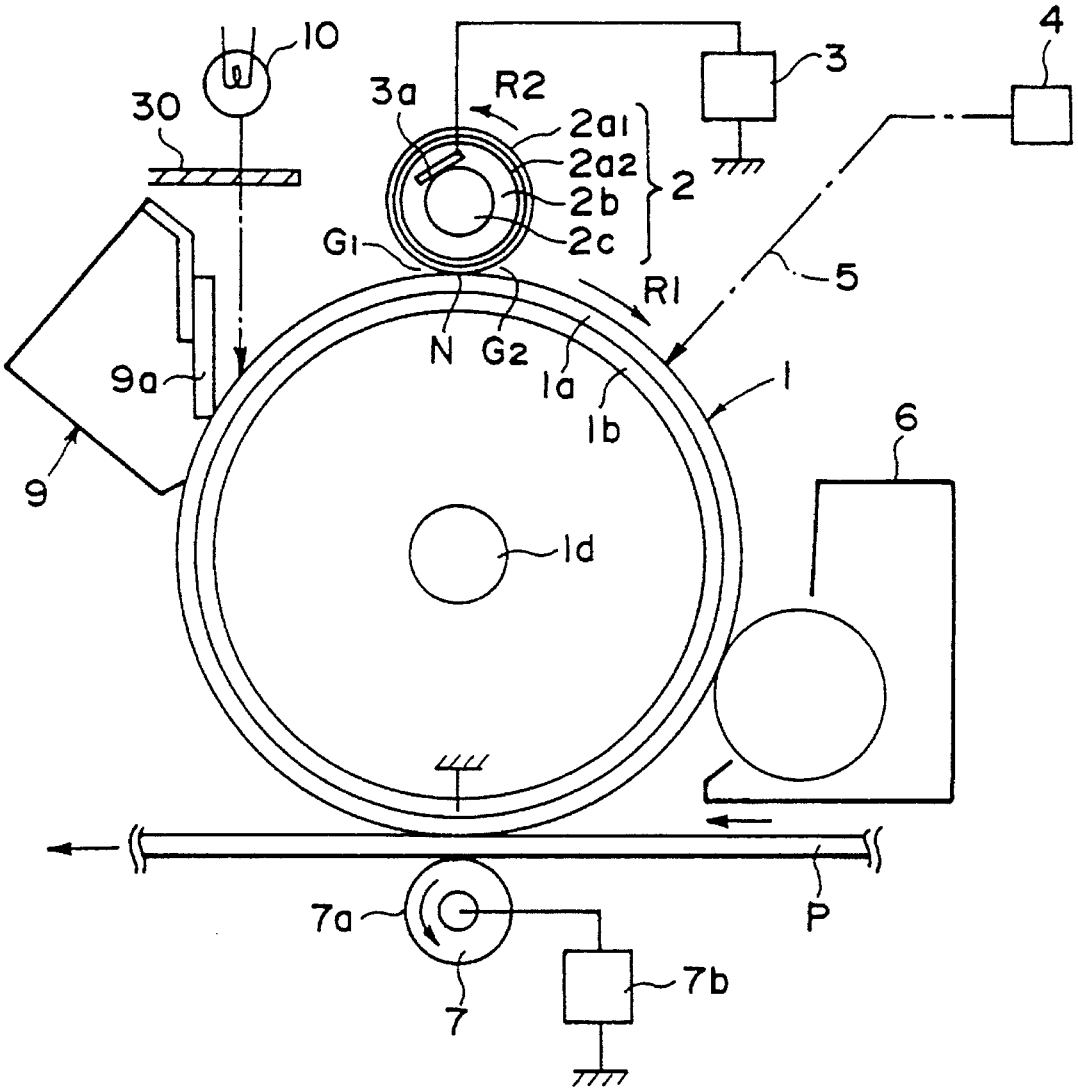
FIG. 1 is a sectional view, of an electrophotographic apparatus according to a first embodiment of the present invention.

FIG. 1 is a sectional view of an image formation portion of an image forming apparatus according to c.

Image formation portion has a cylindrical photosensitive drum 1 as a member to be charged supported rotatably on a main assembly (unshown) of the device. The photosensitive drum 1 is an electrophotographic photosensitive member of drum type having, as base this structure layers, an electroconductive base layer 1*b* of aluminum or the like electrically grounded, and a photoconductive layer (surface to be charged) 1*a* thereon. The entirety of the photosensitive drum 1 is rotated about a supporting shaft 1*d* in the arrow R1 direction at a predetermined peripheral speed.

A charging member 2 is posited above the photosensitive drum 1. The charging member 2 is contacted to the surface to be charged of the photosensitive drum 1, and functions to uniformly charging it to a predetermined polarity, potential while it is contacted to a surface to be charged 1*a* of the photosensitive drum 1. It is a roller type (charging roller). The charging roller 2 is provided with a center core metal 2*c*, an electroconductive layer 2*b* formed on the outer periphery thereof, and a resistance layer $2a_2$, $2_1$ thereon. Charging roller 2 is rotatably supported at the opposite end portions thereof by unshown bearing in parallel with the photosensitive drum 1, and is press-contacted at a predetermined pressure to the surface to be charged 1*a* of the photosensitive drum 1 by urging means (unshown). It is rotated in arrow R2 direction by the rotation of the photosensitive drum 1 in arrow R1 direction. A core metal 2*c* of the charging roller 2 is contacted to an electric energy supply sliding contact 3*a*, and is supplied with a bias voltage from a voltage source 3 through the contact 3*a*. By this, the surface to be charged of the photosensitive drum 1 is charged to predetermined polarity, potential. The charging roller 2 may be driven by the photosensitive drum 1 or may be positively driven codirectionally or counterdirectionally relative to the surface to be charged 1*a* at a predetermined peripheral speed. Alternatively, it may be fixed without rotation.

The photosensitive drum 1 uniformly charged by the charging roller 2, is exposed to image light of object image information by exposure means 4 by laser beam for slit exposure (slit exposure is used in this embodiment). By this, an electrostatic latent image is formed correspondingly to the intended image information on the surface to be charged. The electrostatic latent image is developed with toner by a developing device 6 into a toner image.

The toner image is transferred onto a transfer material P by a transfer device 7. The transfer device 7 is provided with a rotatable transfer roller 7*a* and a voltage source 7*b*, and charging th rear of the transfer material P with the charge of the opposite polarity from the toner, so that the toner image is transferred from the photosensitive drum 1 to the transfer material P. The transfer material P has been fed from an unshown feeding device to a transfer portion between the photosensitive drum 1 and the transfer device 7 at a proper timing in synchronism with the rotation of the photosensitive drum 1.

The transfer material P having received the toner image is separated from the separation, and is fed to unshown fixing device, where the toner image is fixed thereon. Then, it is discharged to the outside of the main assembly of the device. In the case of duplex copy, it is fed back to the refeeding means at the transfer portion.

The photosensitive drum 1 after the image transfer is cleaned by a cleaning blade 9*a* of the cleaning device 9 so that the deposited contamination such as remaining toner is removed, and the charge is removed by a pre-exposure device 10.

The description will be made as to the charging roller 2. As shown in FIG. 1, the charging roller 2 used in this embodiment, comprises a core metal 2*c*, an electroconductive dam layer 2*b* of EPDM or the like having a volume resistivity of $10^4$–$10^5$ Ohmcm, an intermediate resistance layer $2a_2$ of hydrin rubber or the like thereon having a volume resistivity of $10^7$–$10^9$ Ohmcm approx. a surface layer (blocking layer $2a_1$) having a volume resistivity of $10^7$–$10^{10}$ Ohmcm, made of Nylon shape substance such as Torejin (trademark of Teikoku Kagasku Kabushiki Kaisha, Japan). It has a hardness of 50–60 approx. as measured in Asker-c measurement. The charging roller 2 is contacted to the photosensitive drum 1 at total pressure 1600 g so as to be driven by the photosensitive drum 1. The resistance of the charging roller 2 is preferably such that when the photosensitive drum is replaced with an aluminum drum, and the charging roller is supplied with a voltage of 300 V, it is $10^5$–$10^7$ Ohm per nip of 1 $cm^2$ between the charging roller and the drum.

At the upstream and the downstream of the contact portion N formed between the surface to be charged 1*a* of the photosensitive drum 1 and the charging roller 2, a first gap $G_1$ and second gap $G_2$ are formed, respectively. The gap $G_1$ and $G_2$ formed between the surface to be charged 1*a* of the photosensitive drum 1 and the outer peripheral surface of the charging roller 2 are such that while the first gap $G_1$ which is upstream with respect to the movement direction (arrow R1 direction) of th surface to be charged 1*a*, gradually decreases toward the contact portion N, the second gap $G_2$ which is downstream gradually increases away from the contact portion N. The contact portion N is formed substantially over the entire length (axial direction), and therefore, the first gap $G_1$ and second gap $G_2$ are formed over the entire length of the charging roller 2.

Figure 2:
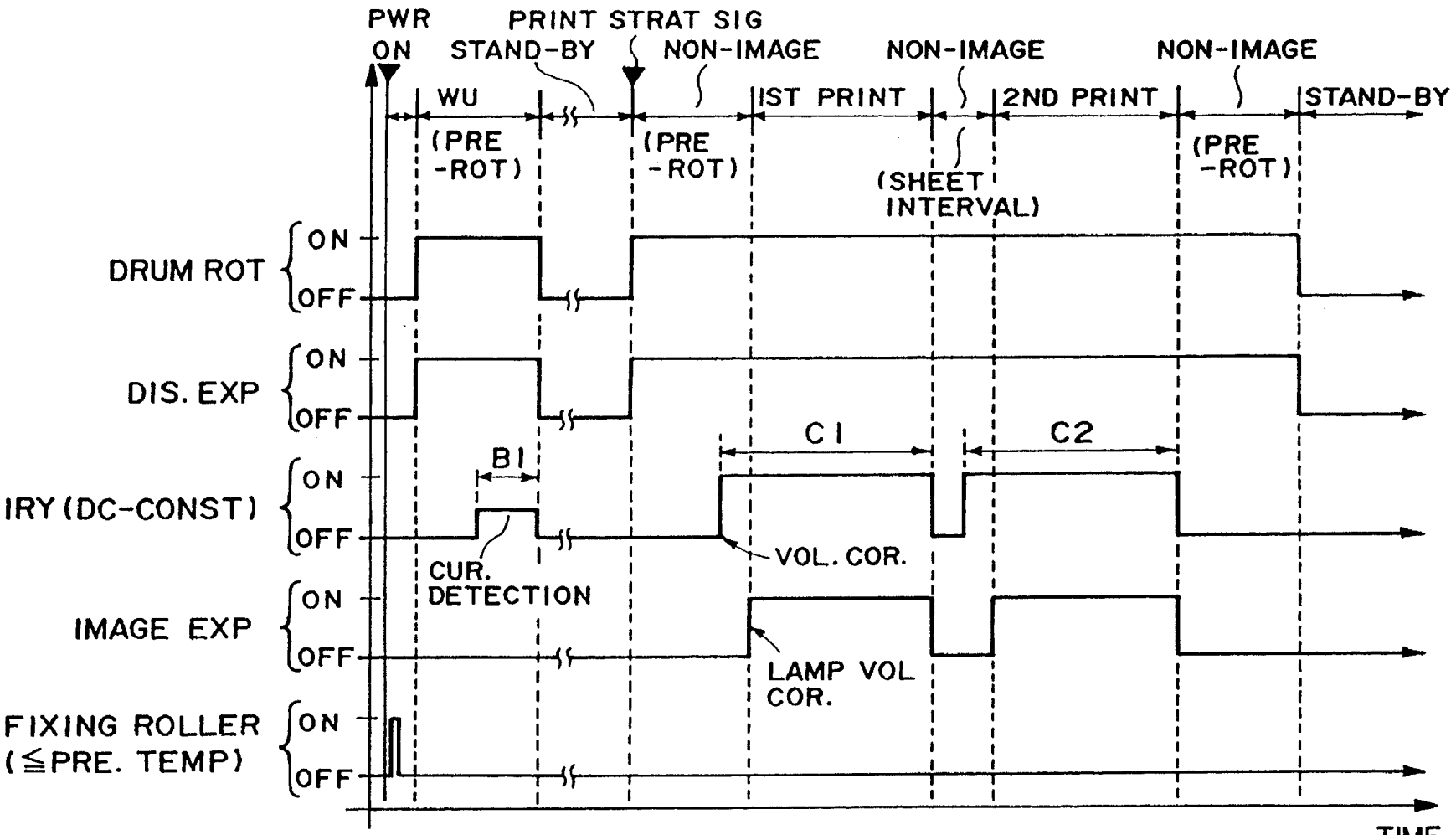
FIG. 2 is an operation sequence diagram, of the electrophotographic apparatus.

FIG. 2 is an example of an operation sequence of the device of FIG. 1. This example deals with a continuous print on two transfer materials.

In FIG. 2, during drum rotation period (device warming-up period) executed upon the actuation of the voltage source for the purpose of image fixing device temperature rise or the like, the charging roller 2 is subjected to a DC constant voltage control, during which the DC current detection is effected to the charging roller 2. During the warming-up period, drum 1 is discharged substantially to OV by the pre-exposure device.

By the detection of the current through the charging roller 2, the current from the charging roller 2 to the drum 1 can be detected, so that the thickness of the photosensitive layer can be estimated.

After the completion of the worming up, the discharging exposure by the rotation, of the drum and by the pre-exposure device 10 is stopped, and the subsequent stand-by state is maintained until the print start signal is produced.

Upon print (copy) start signal, the rotation of the photosensitive member 1 is started so that the pre-rotation period starts. Simultaneously with the rotation start of the drum 1, the discharging exposure lamp 15 is turned on, so that the one full circumference or more of the drum 1 is discharged.

In the period C1, the charging roller 2 is subjected to a constant voltage control with a corrected DC voltage determined on the basis of the current through the charging roller 2 detected during the warming-up period. At this time, the drum 1 is charged by the charging roller 2 for the image formation. Thus, the charging roller 2 charging the image formation region in which the toner image can be formed, when the drum 1 is rotated.

It is preferable that the timing of the detection of the current through the charging roller 2 is such that it is for the non-image region in which the toner image is not formed. The current detection operation may be carried out during the before rotation period which is before the charging operation for the image formation and after the production of the print start signal.

Upon start of the constant voltage control for the charging roller with the corrected voltage, the image formation is carried out for the first sheet with the image exposure.

Upon the charging roller 2 of the image formation for the second print, the drum 1 is subjected to a post-rotation period, during which one full circumference or more of the drum 1 is discharged by the discharging exposure lamp 10, and the rotation of the drum 1 and the discharging exposure are stopped. Then, the apparatus is placed under the stand-by state until the input of the next print start signal.

With the above-described structure, when the drum surface is scraped by the operations so that the photosensitive layer thickness is reduced, the detected DC current in the DC constant voltage control period B1 when the charging roller 2 is opposed to the surface of the non-image-formation region, increases, and the drum 1 is charged by the charging roller 2 under the charging roller DC constant voltage control with the corrected voltage based on the decreased voltage due to the increase of the detected DC current. Thus, the drum 1 is charged to the potential substantially equal to that at the initial stage where the drum is not scraped.

If the resistance of the charging roller 2 increases under the low humidity ambience (for example, 15° C., 10%), the detected DC current during the charging roller DC constant voltage control in the period B1, decreases. The charging by the charging roller 2 is carried out under the charging roller DC constant voltage control with the increase-corrected voltage in accordance with the detected DC current, and therefore, the k0charge potential of the drum 1 is constant despite the resistance variation of the charging roller 2 due to the ambience change.

The DC current and the corrected voltage thus detected is held until the voltage source of the image forming apparatus is shut off.

For the purpose of the image density stabilization, it is effective to carry out the detection once a day, for example, the first start in the morning. When, for example, the voltage source of the device is stopped for a short period to permit jammed sheet clearance, the current detection is carried out again, and the corrected voltage is renewal upon the reactuation of the voltage source. Therefore, it is probable that the corrected voltages before and after the deactuation of the voltage source are different from each other depending of the detection accuracy of the current. If even small amount of the change in the corrected voltage in a short period, the operator feels strange, and therefore, the temperature adjustment value is reset upon the image formation operation.

In order to improve the operativity of the image forming apparatus, the charging roller constant voltage application, the current detection and the corrected constant voltage control are carried out at the time of start up first in the morning, and the corrected constant voltage is maintained during the same day.

As the method for discriminating the "first in the morning", the results of practical tests exhibit that it is recognized when the fixing roller detected temperature is lower than a predetermined level. The predetermined temperature is 30° C.–130° C., further preferably approx. 100° C.

Voltage correction method

Next, the description will be made as to a charging method using a DC voltage source 3.

First, the charging mechanism when the charging roller 2 is supplied with a DC voltage from the DC voltage source.

The used photosensitive member 1 is an OPC photosensitive drum of the negative. More particularly, it comprises a photosensitive layer which includes a CGL layer of azo-pigment (carrier generating layer), a CTL layer (carrier transfer layer) of a mixture of hydrazone and resin material of a thickness of 24 μm (negative organic semiconductor layer (OPC layer) thereon. Such a OPC photosensitive drum 1 is rotated, and the charging roller 2 is contacted to the surface thereof. The charging roller 2 is supplied with DC voltage $V_{DC}$, and is contacted to the OPC photosensitive drum 1 in the dark to charge it. The investigation was made as to the relation between the surface potential $V_D$ of the OPC photosensitive drum 1 and the applied DC voltage to the charging roller 2.

In FIG. 3, the line "24 μm" indicates the results of the investigation. The charging includes a threshold for each drum film thickness relative to the application DC voltage $V_{DC}$, as will be understood from FIG. 3, (*a*).

The charge starting voltage is defined as follows. An image bearing member having a 0 potential is charged by a charging member supplied only with a DC voltage, and the DC voltage is gradually increased. Application DC voltages. The surface potential of the photosensitive member as the image bearing member is plotted on a graph. The data are taken for each 100 V of the DC potential. The DC potential point corresponds to the first surface potential appearing on the surface, 10 points are obtained therefrom. From the 10 plots, a straight line is drawn using least square approximation in statistics. The value of the application DC voltage at surface potential 0 on the line is defined as the charge starting voltage. The line on the graph of FIG. 3 is made on the basis of the least square approximation.

Thus, the DC application voltage $V_{DC}$ to the charging roller 2 and the surface potential on the OPC photosensitive drum 1 surface and the charge starting voltage $V_{TH}$ are related as follows:

$$V_D = V_{DC} - V_{TH} \quad (1)$$

This equation can be from Paschen (Paschen) law.

Figure 4:
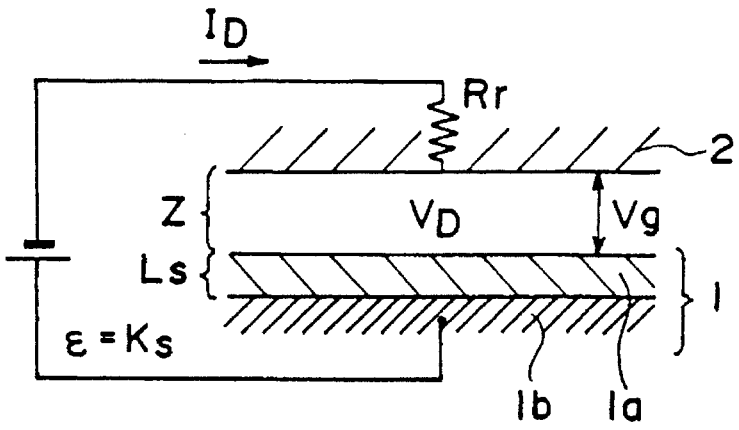
FIG. 4 is an equivalent circuit diagram formed in a microscopical space at a contact portion between a photosensitive layer and charging roller.

FIG. 4 shows an equivalent circuit constituted by the charging roller 2, OPC photosensitive layer and the microscopical space Z in the contact portion therebetween. When the total resistance $R_r$ of the charging roller 2 is small, the voltage drop $I_D Rr$ resulting from the current $I_D$ into the photosensitive layer 1*a* is so small as compared with $V_{DC}$ that it can be ignored. If $R_r$ is neglected, the voltage Vg across the space Z is:

$$Vg = V_{DC} \times Z / (L_S / K_S + Z) \quad (2)$$

$V_{DC}$: application voltage
Z: gap
$L_S$: photosensitive layer thickness
$K_S$: photosensitive layer dielectric constant From Paschen law, the discharge breakdown voltage Vb can be approximated by the following first order equations (3) and (4) when the z=8 microns or larger:

$$Vb=312+6.2Z\ (Vb>0) \quad (3)$$

$$Vb=-(312+6.2Z)\ (Vb<0) \quad (4)$$

Figure 5:
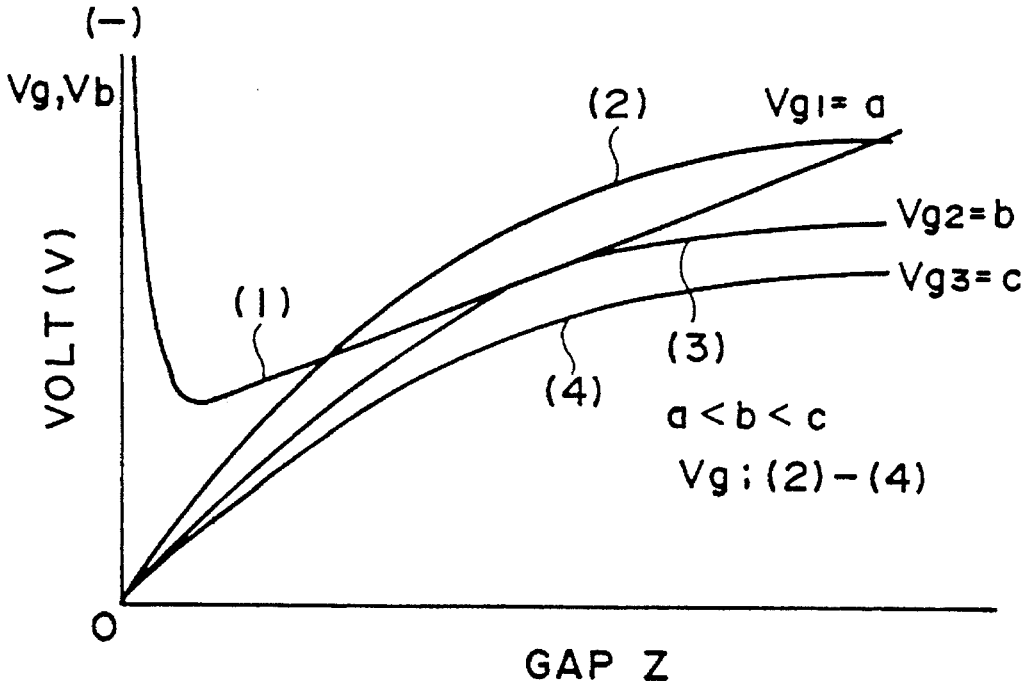
FIG. 5 is a graph of gap gaps. Gap breakdown voltage.

Since Vb<0, equations (2) and (4) are expressed in FIG. 5. The abscissa represents gap distance Z, and the ordinate represents a gap breakdown voltage. The convex-down curve (1) is Paschen curve, and convex-up curves (2)–(4) are properties of the gap voltage Vg with the parameter z.

When the curve (1) and the curve (2)–(4) intersect, the discharge occurs. At the point of the discharge start, a discriminant obtained by Vg=Vb is 0. This is the discharge start limit, and therefore, $V_{DC}=V_{TH}$.

The Paschen law is related to the discharge development in a gap. In the charging process using the charging roller 2, the ozone is produced although the amount is small in the proximity of the charging portion ($10^{-2}$–$10^{-3}$, as compared with the corona discharge), and therefore, the charging by the charging roller is considered as involving the discharge development. Therefore, in order to control $V_D$ by $V_{DC}$, The use is made with $$V_{DC}=V_R+V_{TH} \quad (5)$$

$V_R$: target surface potential

The potential target value $V_R$ is set, and $V_{TH}$ is obtained by equation (5), and is added thereto, by which the $V_D$ approaches $V_R$.

As will be understood from equation (5), threshold voltage $V_{TH}$ is determined by:

$$D=L_S/K_S \quad (6)$$

The dielectric constant $K_S$ of the photosensitive layer changes due to the temperature, humidity or the like around the photosensitive member, and the thickness $L_S$ of the photosensitive layer decreases with the use.

Thus, the surface potential $V_D$ changes with the change of threshold voltage $V_{TH}$ depending on the circumference ambience or the degree of use. In other words, if the $K_S$ and $L_S$ are known, the DC corrected voltage $V_{DC}$ for providing the proper value of the surface potential $V_D$ can be determined.

Figure 6A:
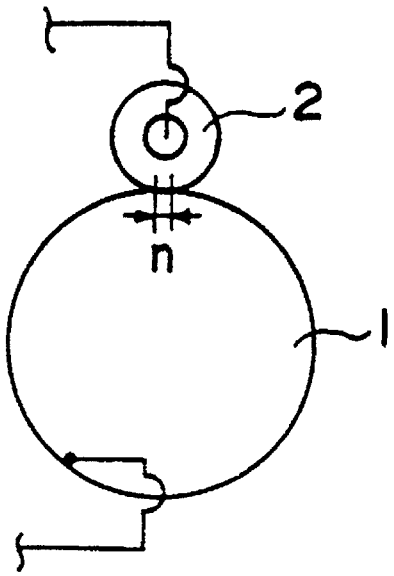
FIG. 6, (*a*) is illustrates a contact nip between a photosensitive member and a charging roller.
Figure 6B:
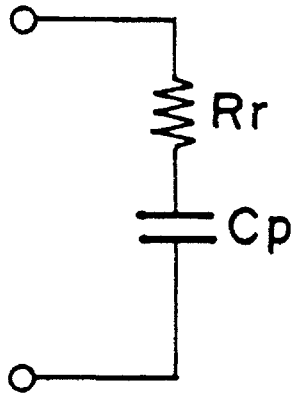

Here, the electrostatic capacity $C_p$ of the photosensitive drum 1 plus charging roller 2, as shown in FIG. 6 (*a*) and (*b*), is provided by the nip n at the contact portion between the photosensitive drum 1 and the charging roller 2. When the contact area at the nip is $S_p$, the following results from the equivalent circuit of FIG. 6, (*b*).

$$C_p=S_p\times K_S/L_S=S/D \quad (7)$$

Namely, $C_p$ is proportinal tol/D. So, if $C_p$ is obtained, proper DC voltage $V_{DC}$ can be obtained by equation (5).

In this embodiment, in place of determining the $C_p$ of the drum (photosensitive member), the simple measurement is effected for the change of the charging property due to the change of the discharge impedance due to the film thickness of the charge transfer layer (CT layer) ($L_S$) of the drum, as shown in FIG. 6, by which the change of the photosensitive member $C_p$ is estimated, and the application voltage is corrected.

FIG. 3, (*a*) is plots of the application voltage to the charging roller 2vs. The drum surface potential for each drum CT layer thickness. Similarly, the DC current at the time is given in FIG. 3, (*b*). As will be understood from this Figure, the charging property, voltage/current property and discharge start voltage change depending on the drum CT layer thickness.

Figure 7A:
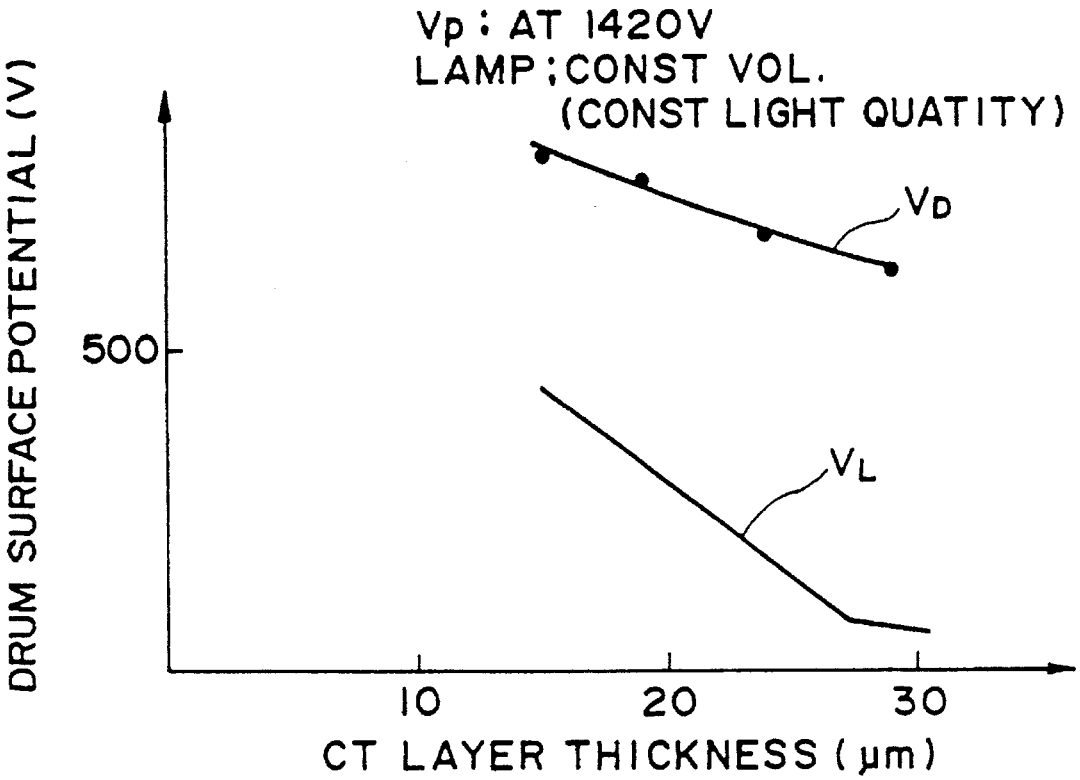
FIGS. 7, (*a*) and (*b*) are graphs of charging property film thickness dependence property.
Figure 7B:
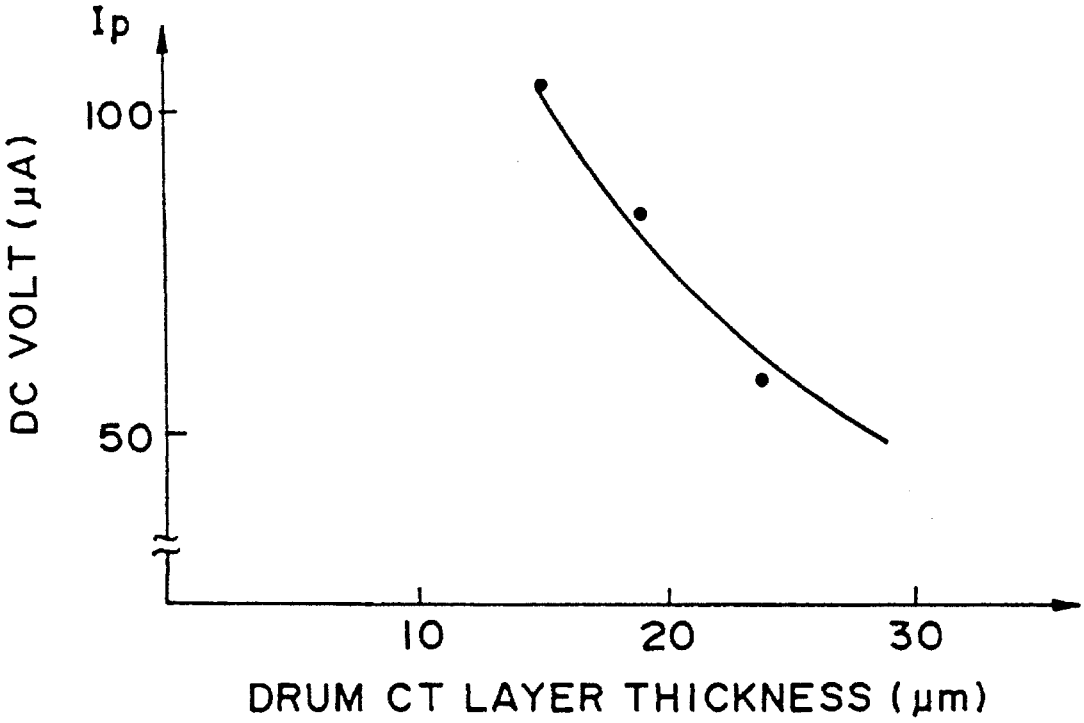

The properties are expressed in FIG. 7, (*a*), (*b*), as the drum surface potential and the DC current for the drum CT layer thickness upon a given constant voltage application. The relation between the drum surface potential and DC current in accordance with the CT layer thickness can be seen. With increase of the CT layer thickness, the drum surface potential (black portion potential $V_D$ and white potential $V_L$) and the DC current increase. By measuring the DC current upon a specific constant voltage application, the surface potential can be estimated or predicted in accordance with the drum $C_p$.

Figure 8:
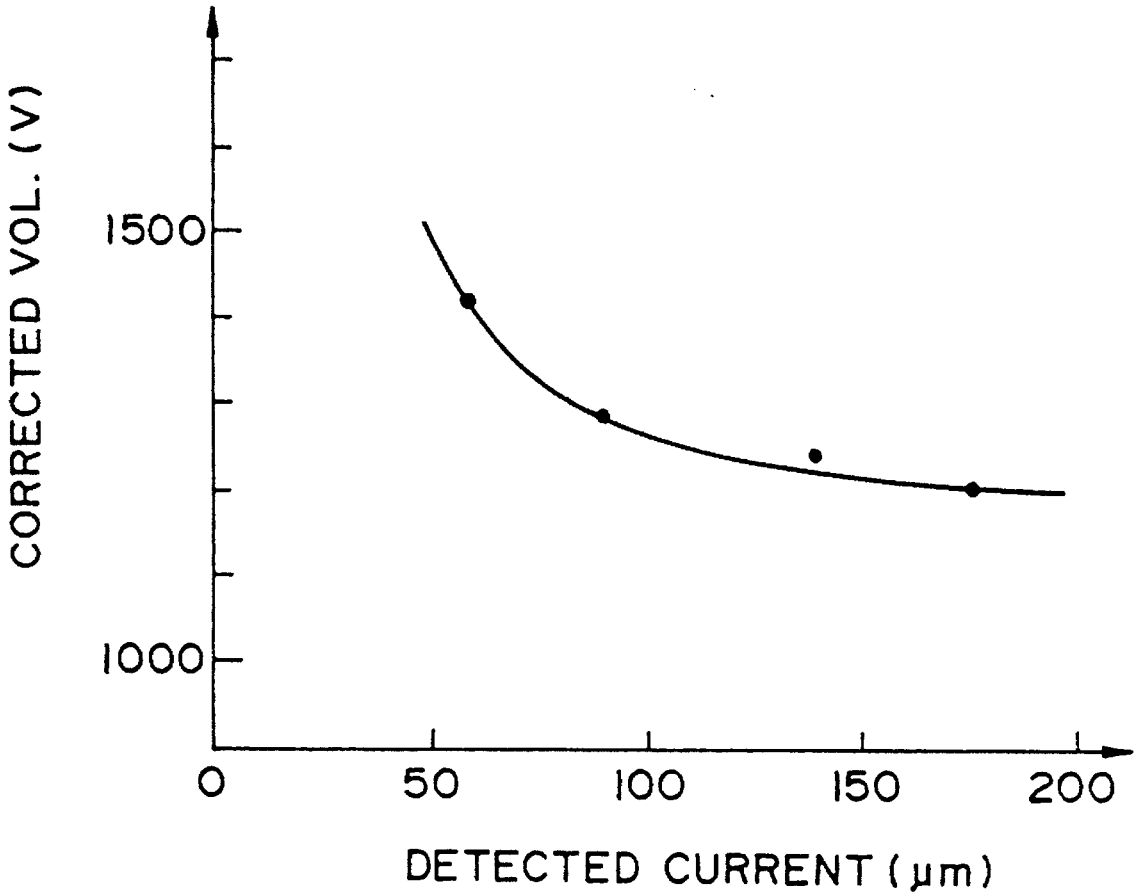
FIG. 8 is a graph of detected voltages. Corrected voltage output.
Figure 9A:
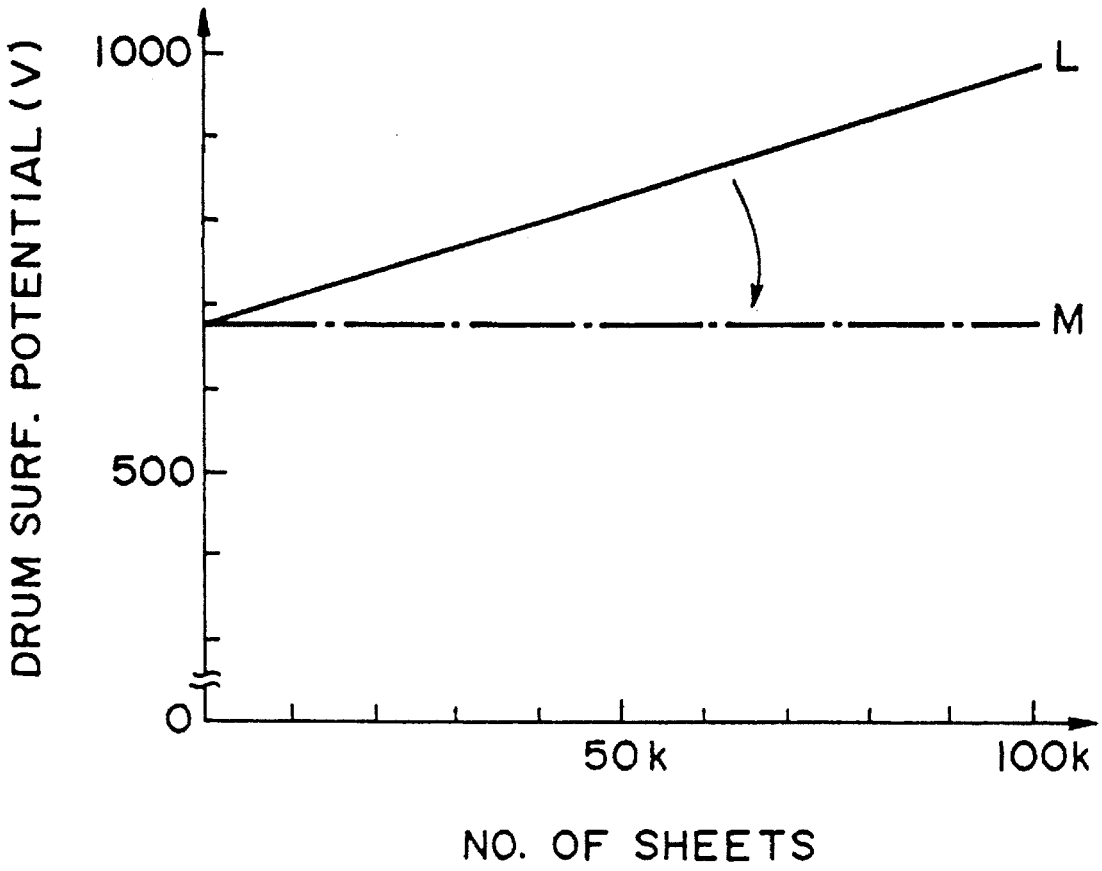
FIGS. 9, (*a*) and (*b*) are graphs of potential and CT layer thickness relative to the number of the processed sheets.
Figure 9B:
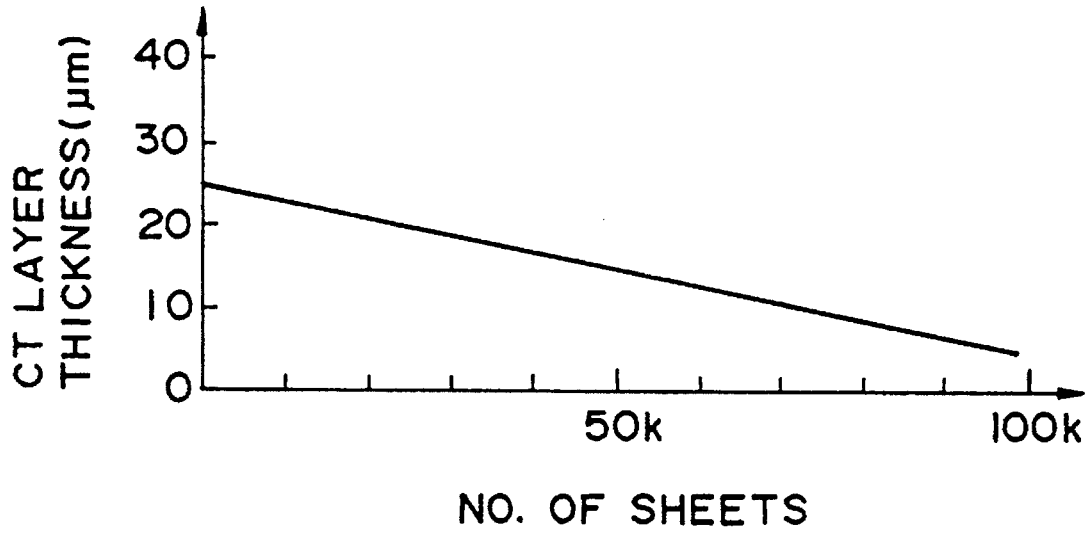

FIG. 8 show a relation between the average detected current and the corrected voltage output for the control of the drum surface potential even if the $C_p$ change occurs due to the drum CT layer thickness change, on the basis of the above analysis. The correction is effected such that the voltage output decreases with the increase of the average detected current. FIG. 9, (*a*) and (*b*) shows the experiment result with the use of the correction.

Abscissa represents the number of processed sheets ("K" means 1000 sheets) namely the number of image forming operations, and the change of the drum surface potential is shown. The the surface potential change when a specified constant voltage is applied always to the charging member irrespective of the number of image forming operations, is shown by L. When the DC current upon the constant voltage application to the charging member is detected, and the corrected constant voltage application in accordance with the detected current is effected (the charging power of the charging member is determinated in accordance with the average detected current), the constant drum surface potential can be maintained despite the increase of the number of sheets processed, as indicated by M.

In these experiments, the OPC photosensitive drum 1 described above was used. Using the image forming apparatus shown in FIG. 1, a large number of sheets are processed.

It is preferable to increase the voltage applied to the original illumination lamp 4 to increase the image exposure amount in accordance with the increase of the average detected current.

Under the low humidity ambience, the resistance of the charging roller 2 increases, and therefore, the detected DC current during the charging roller DC constant voltage control in the period B1 and the period B2 decreases. Under the charging roller DC constant voltage control with the increase-corrected voltage in accordance with the detected DC current, the image formation region of the drum 1 is charged by the charging roller 2, and the image formation is carried out by the exposure using the corrected lamp voltage, and therefore, the k0charge potential of the drum 1 is made constant despite the resistance variation under the ambience around the charging roller 2.

Figure 10:
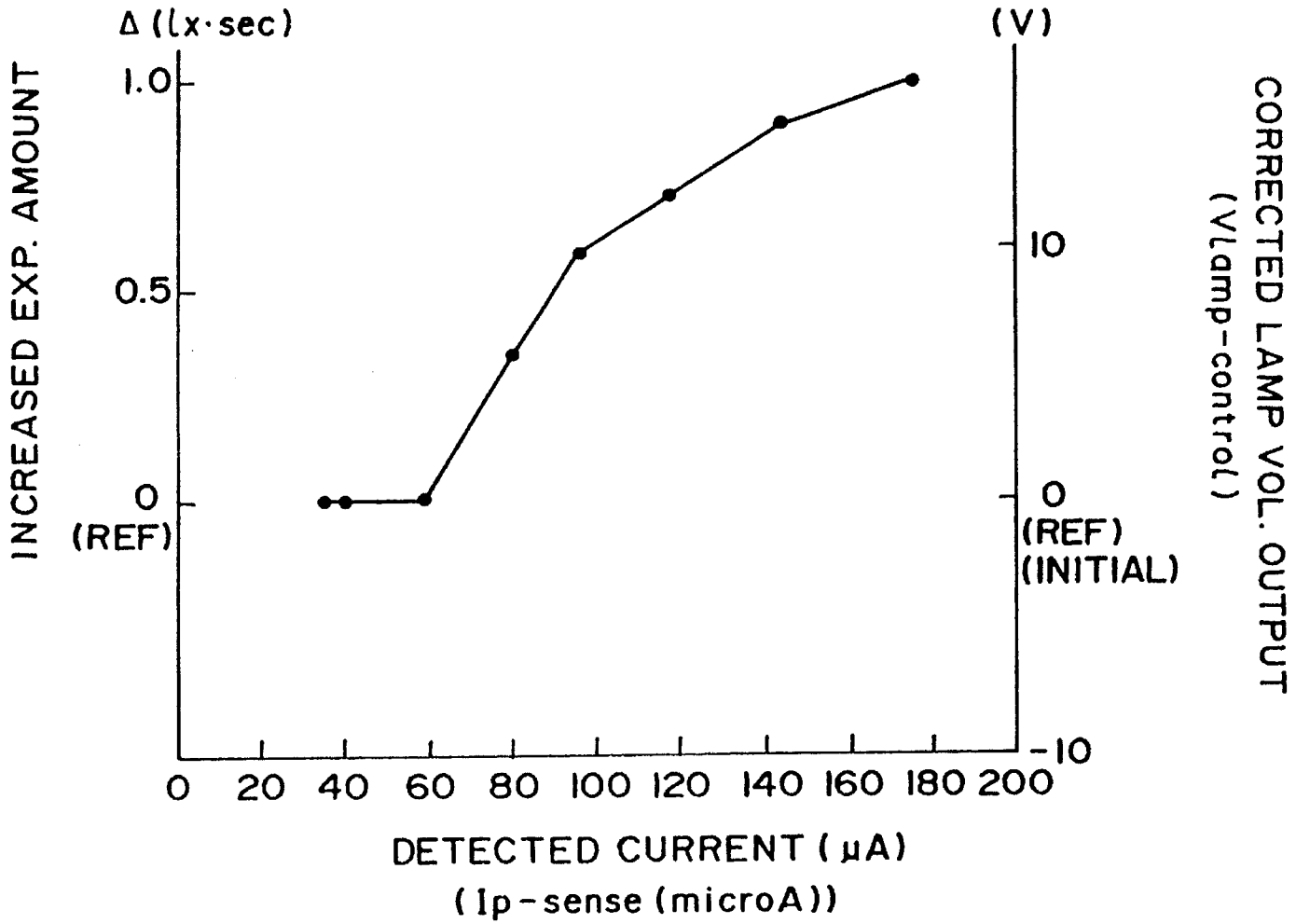
FIG. 10 shows a relation among an average detected current, a corrected lamp voltage output and an increase exposure amount of surface of the drum.

FIG. 10 shows an interrelation among the average detected current, corrected lamp voltage output applied to the original illumination lamp 4 for the image exposure, and the increase exposure amount for the drum surface.

Figure 11A:
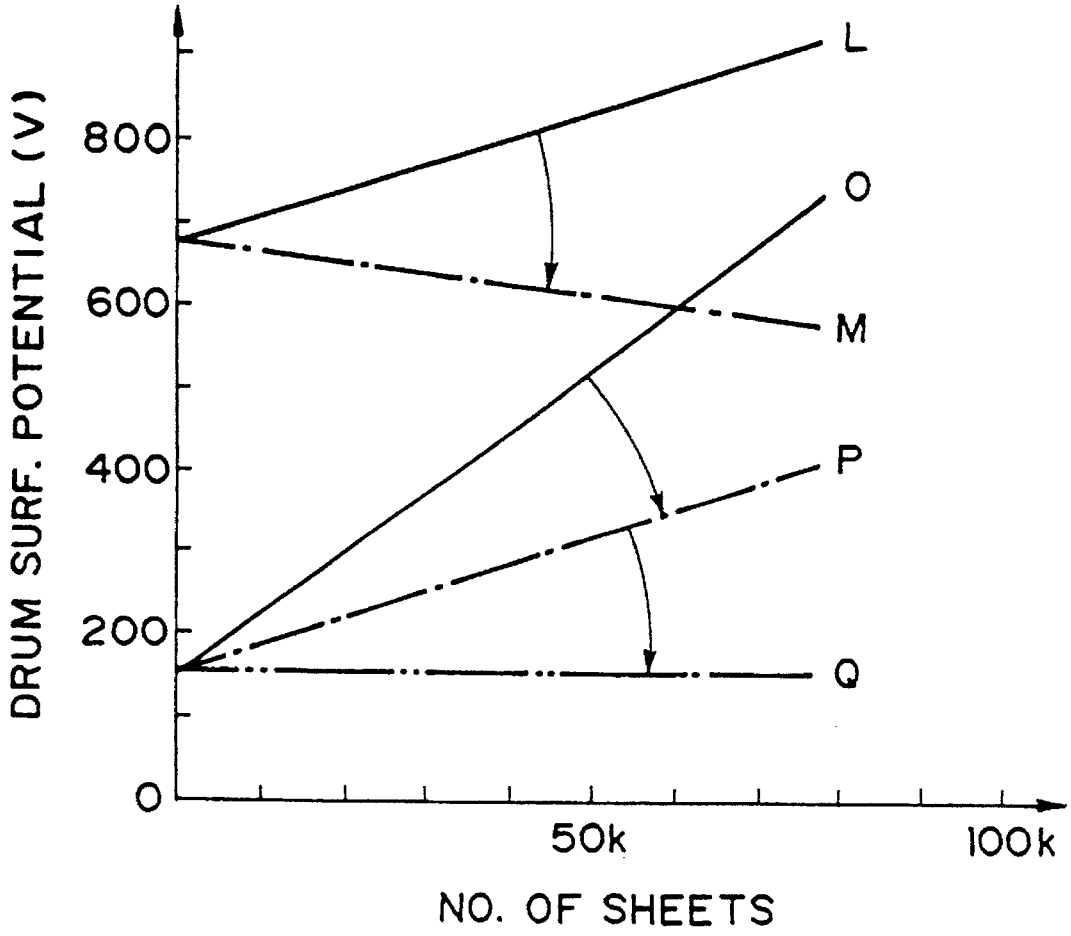
FIG. 11 is a graph of a potential and a CT layer thickness relative to the number of the sheets processed.
Figure 11B:
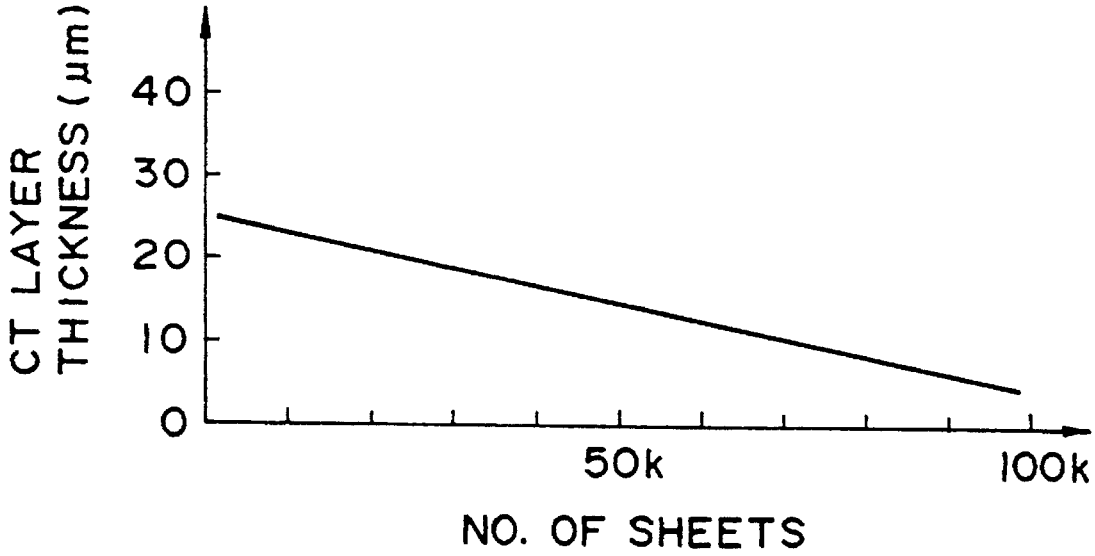

FIG. 11, (*a*), (*b*), show the experiment results with this correction. The abscissa is the number of the processed sheets, namely, the number of image forming operations, and the change of the drum surface potential is indicated.

The surface potential change when a specified constant voltage is applied always to the charging member despite the film thickness decrease of the photosensitive member, is indicated by dark portion potential $V_D$ and L, light portion potential $V_L$ being 0. When the DC current upon the constant voltage application to the charging roller is detected, and the application voltage to the charging roller is corrected in accordance with the detected current, and the constant voltage control is effected with this voltage. As shown by M, P, the constantly deceasing tendency drum surface potential can be provided despite the increase of the number of the processed sheets.

Additionally, the voltage applied to the image exposure lamp is increased in accordance with the increase of the average detected current to increase the exposure amount, by which the light portion potential decreases to Q, and as a result, the dark portion potential $V_D$ is Q, and light portion potential $V_L$ is Q. By the decreasing tendency control for the dark portion potential $V_D$, the rising ratio of the dark portion potential $V_L$ is suppressed, and the width of the exposure amount change can be suppressed to a low level. With the increase of the average detected current of the charging roller beyond the predetermined value, the film thickness of the photosensitive member is discriminated as being reduced from the initial thickness. As shown in FIG. 11, (*a*), by M, the corrected voltage for the charging roller is determined such that the dark portion potential decreases with the decrease of the film thickness. The charging roller is constant-voltage controlled by the charging roller with this corrected voltage, so that the portion on which the image is going to be formed is charged to $V_D$. As shown in FIG. 10, when the average detected current is not higher than a predetermined value (60 μA), the lamp light quantity is made constant. Namely, it is discriminated that the film thickness change of the photosensitive member does not occur, and the resistance change of the charging roller occurs.

The charging member 2 may be a roller type, blade-like type, block-like type, rod-like type, belt-like type or the like.

The description will be made as to means 30 for changing the light quantity from the pre-exposure device 10 to the photosensitive member 1.

As for the changing means 30, color filters having various transmission factors are inserted between the pre-exposure device and the photosensitive member, as an example.

Figure 12:
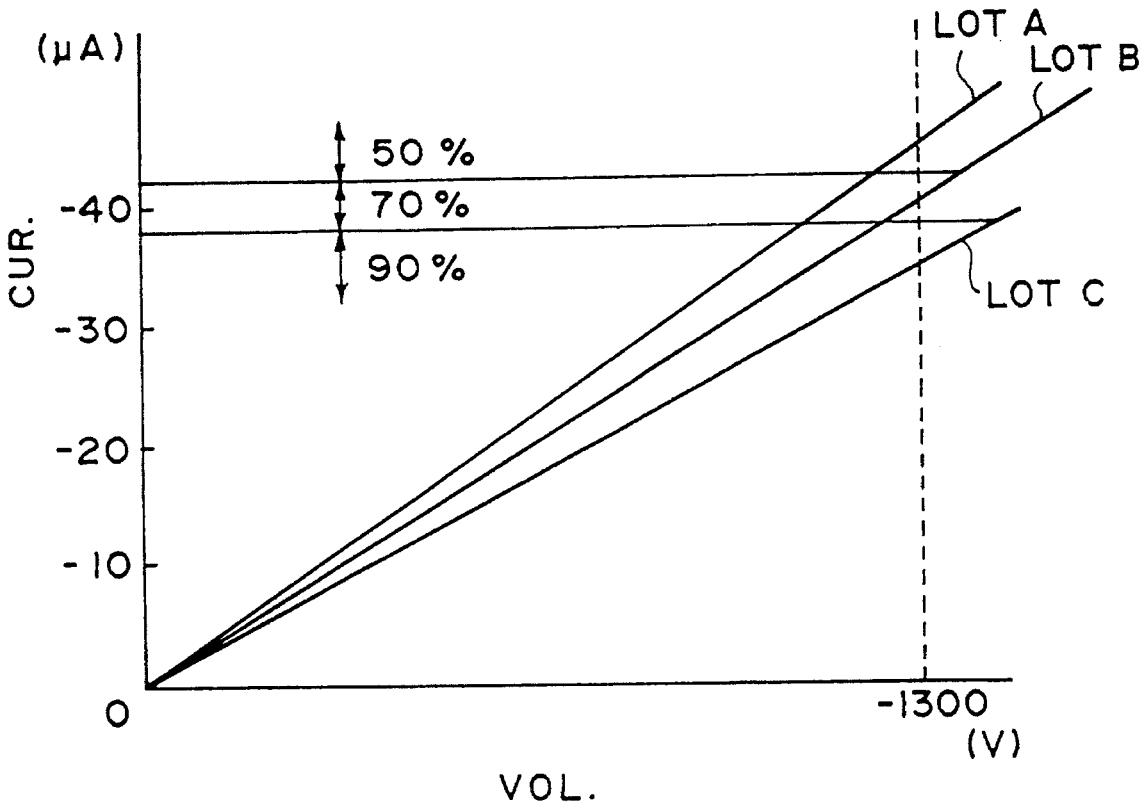
FIG. 12 shows a relation, between the current and a voltage upon voltage application to the drums in various lots and a selection region of a filter.

The color filters have light transmittance of 50%, 70%, 90% (three filters). In FIG. 12, three photosensitive members (lot A–C) having different photosensitivities and the same thickness were prepared. The voltage applied to the charging member 2 is changed, and the current through the charging member 2 is detected. Before the measurement of the current, the photosensitive member is uniformly exposed without the filter. The filter used actually in the device was selected from the three filters on the basis of the current at the initial stage of use of the photosensitive member when the constant voltage (−1300 V) is applied to the charging member, as shown in FIG. 2.

As shown in FIG. 12, the filter having the transmission factor of 70% is used for the photosensitive member (lot B) having current I of −38–42 μA upon −1300 V application, and the filter having the transmission factor of 90% is used for the photosensitive member (lot C) having −38 micro-ampere or large, and the filter having the transmission factor of 50% is used for the photosensitive member (lot A) having −42 micro-ampere or smaller. With the increase of the average detected current, the light quantity incident on the photosensitive member by the pre-exposure device 10 is reduced.

To permit insertion of the filter, the pre-exposure light quantity is increased by approx. 50% as compared with usual case.

Thus, the average detected current at the initial stage is subly made equal for each of the photosensitive members (lot A–C) having the same thicknesses and different sensitivities.

By changing the light transmittance of the filter for each photosensitive member in this embodiment, the average detected current value I, at the initial sage upon −1300 V application and the drum potential $V_D$ provided by the charging roller 2 for the image formation are converged to I=35±2 μA, $V_D$=−680±30 V, respectively. The other conditions are set so as to provide proper images by −680 V of the drum potential. The filter may be selected in accordance with the lot of the photosensitive member used in the device, from three kinds of filters.

When the incident light quantity to the photosensitive member by the pre-exposure device is made the same irrespective of the kind of the photosensitive member without use of the filter, as in the prior art, I=−35±4 μA, $V_D$=−680±70 V result, and several of the drums exhibit slightly darker or thinner images.

Embodiment 2

The description will be made as to a method of insertion of the filter according to another embodiment of the present invention. The structures and operations other than the filter are the same as in embodiment 1, and therefore, the detailed description thereof is omitted.

Figure 13:
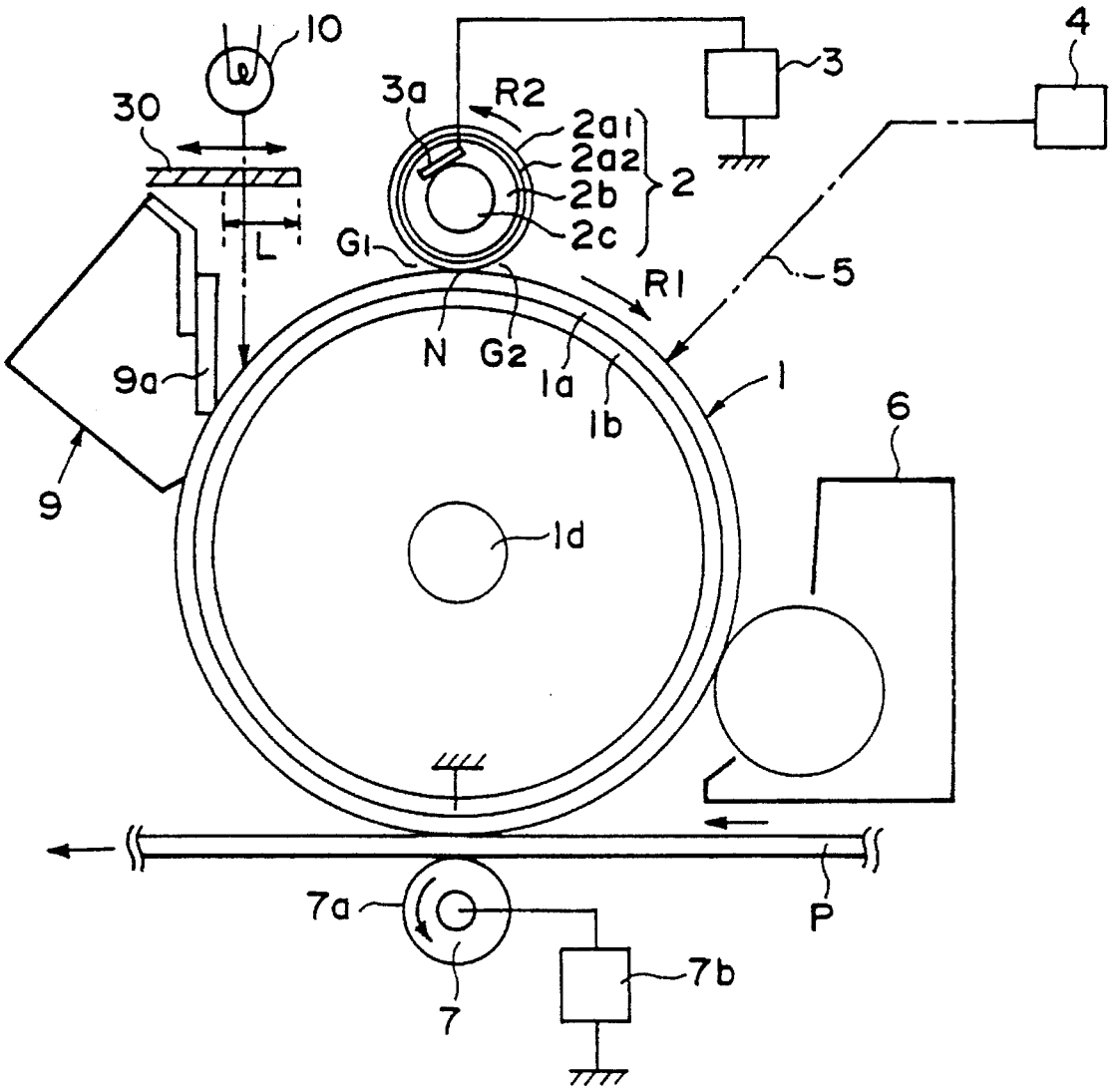
FIG. 13 is a sectional view of an image forming apparatus according to embodiment 2 of the present invention.
Figure 14:
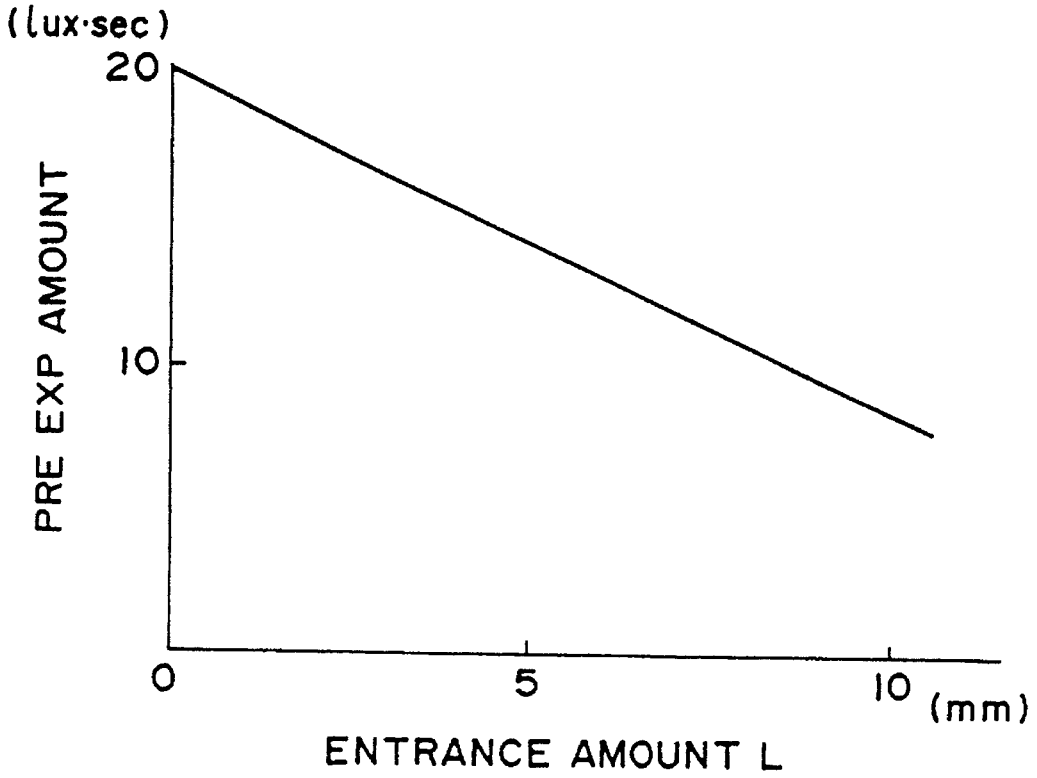
FIG. 14 shows a relation between an entering amount L of the film and a before exposure amount of the photosensitive member.
Figure 15:
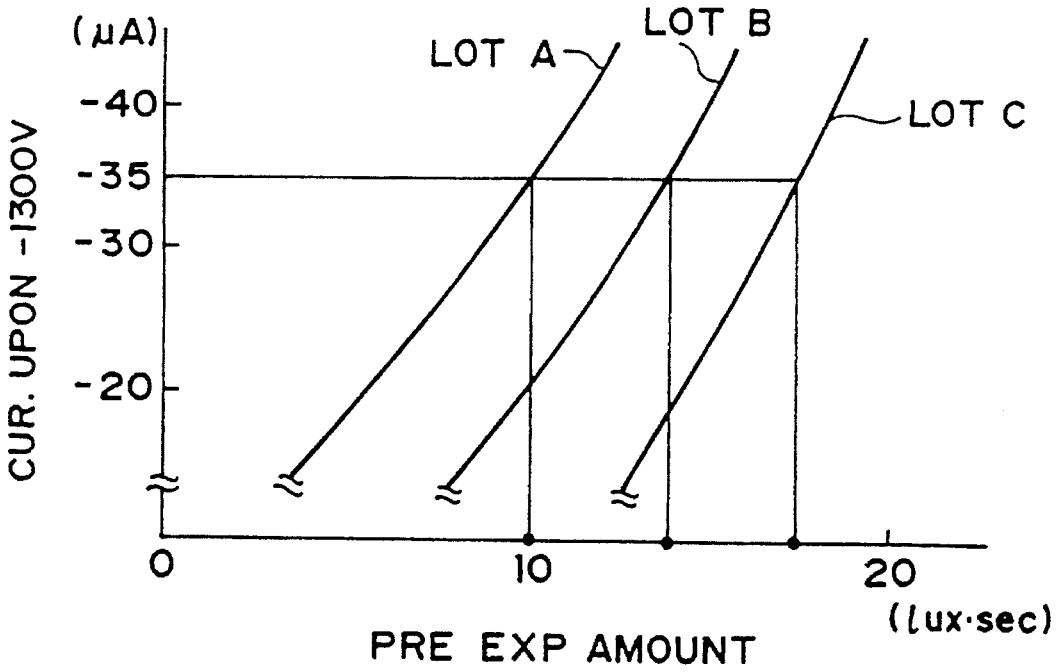
FIG. 15 shows a relation between a before exposure amount and a current upon application of constant voltage (−1300 V) to the photosensitive member in each lot.

In this embodiment, as shown in FIG. 13, the entering amount L of the filter by the changing means 30 is made variable. FIG. 14 shows a relation between the entering amount L of the filter and the pre-exposure light quantity on the surface of a new photosensitive member by the pre-exposure device. FIG. 15 shows a relation between the light quantity on the new photosensitive member by the pre-exposure device and the current through the charging member when a voltage of −1300 V is applied to the charging member. Prior to the detection of the current through the charging member, the photosensitive member is uniformly exposed by the pre-exposure device. As shown in FIG. 15, the entering amount L of the filter is adjusted so that the current through the charging member is constant (−35 μA) despite the (lot A–C) of the new photosensitive members. More particularly, the thickness of the photosensitive layer of the photosensitive member at the initial stage is discriminated as being the same despite the kind of the photosensitive member.

A filter having a transmission factor of 70% was used. By changing the entering amount of the filter for each photosensitive member in this manner, the current and the voltage are converged to I=−35±0.5 μA, $V_D$=−680±10 V, so that better images can be provided than in embodiment 1. The cost can be reduced because only one kind of the filter is required.

Figure 16:
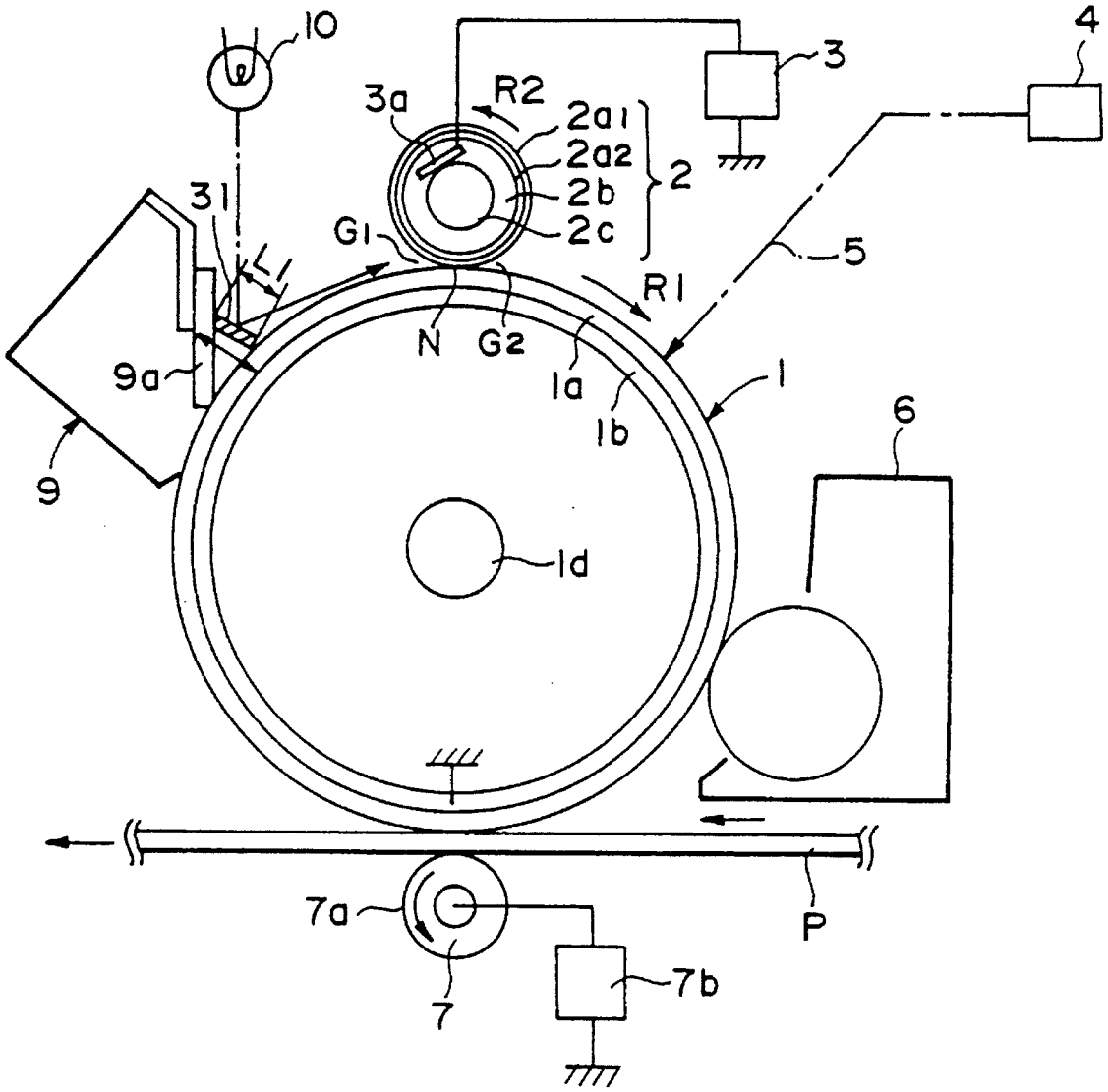
FIG. 16 is a sectional view of an image forming apparatus according to embodiment 3 of the present invention.

In embodiments 1 and 2, as shown in FIG. 16, there is not reflection member 31 for inserting the light into the gap $G_1$ at the upstream with respect to the motion of the photosensitive member surface to improve the charging property. More particularly, in the embodiment 2, I=−35±5 μA, $V_D$=−680±80 V without the filter, but they can be converged to I=−35±0.5 μA, $V_D$=−680±10 V.

In the prior art, the photosensitive members with which I<−39.5 μA, I>−30.5 μA, are deemed as rejects. But, this embodiment is effective to improve the yield.

Embodiment 3

Another embodiment of the changing means for changing the light quantity incident on the photosensitive member, will be described. In this embodiment, in place of using the filter in embodiments 1 and 2, the use is made with a reflection member 31 for reflecting the light emitted from the pre-exposure device toward the gap $G_1$ at the upstream side. The other structures and operations are the same as in embodiment 1, and therefore, the description is omitted.

Figure 17:
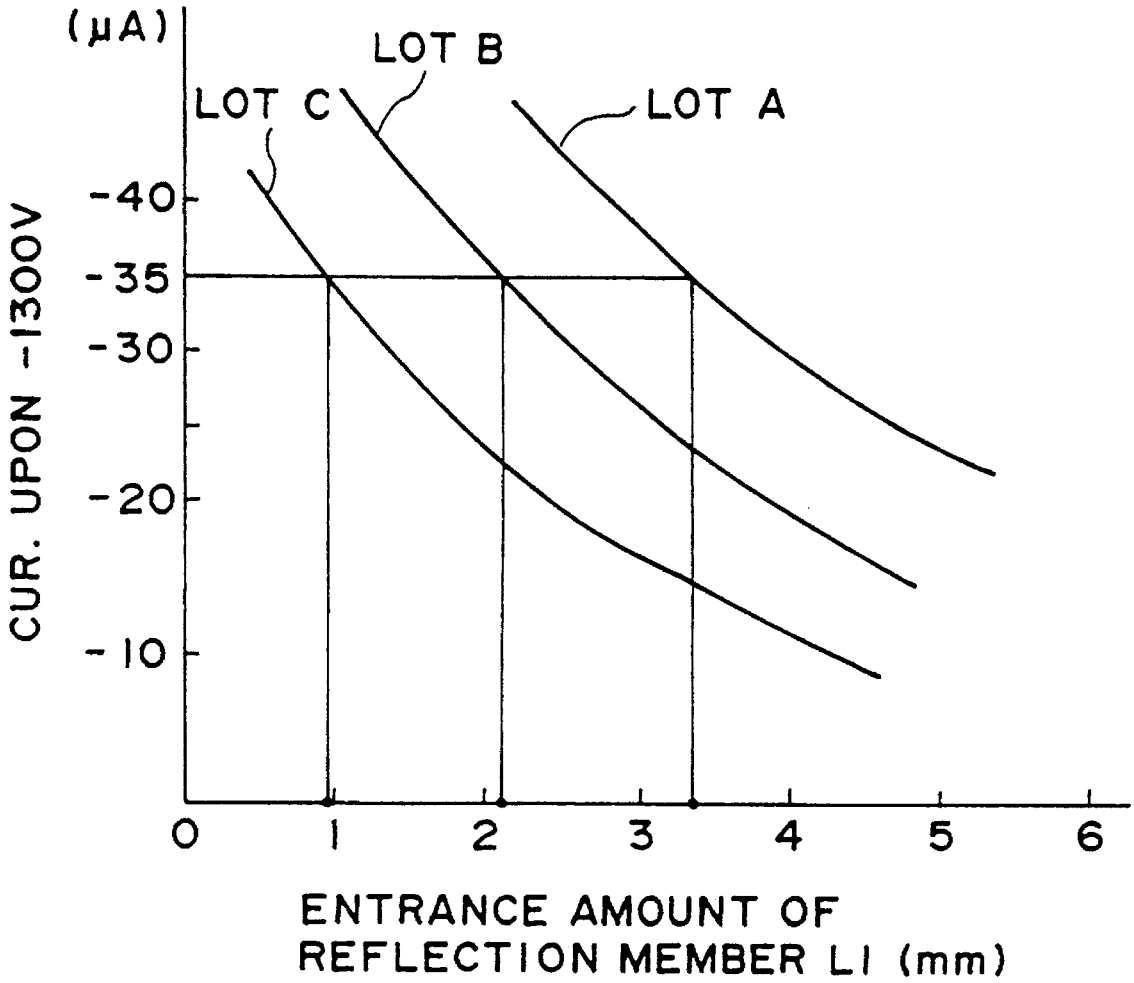
FIG. 17 shows a relation between an entering amount L1 of the reflection member and a current upon −1300 V application to photosensitive member in each lot.
Figure 18:
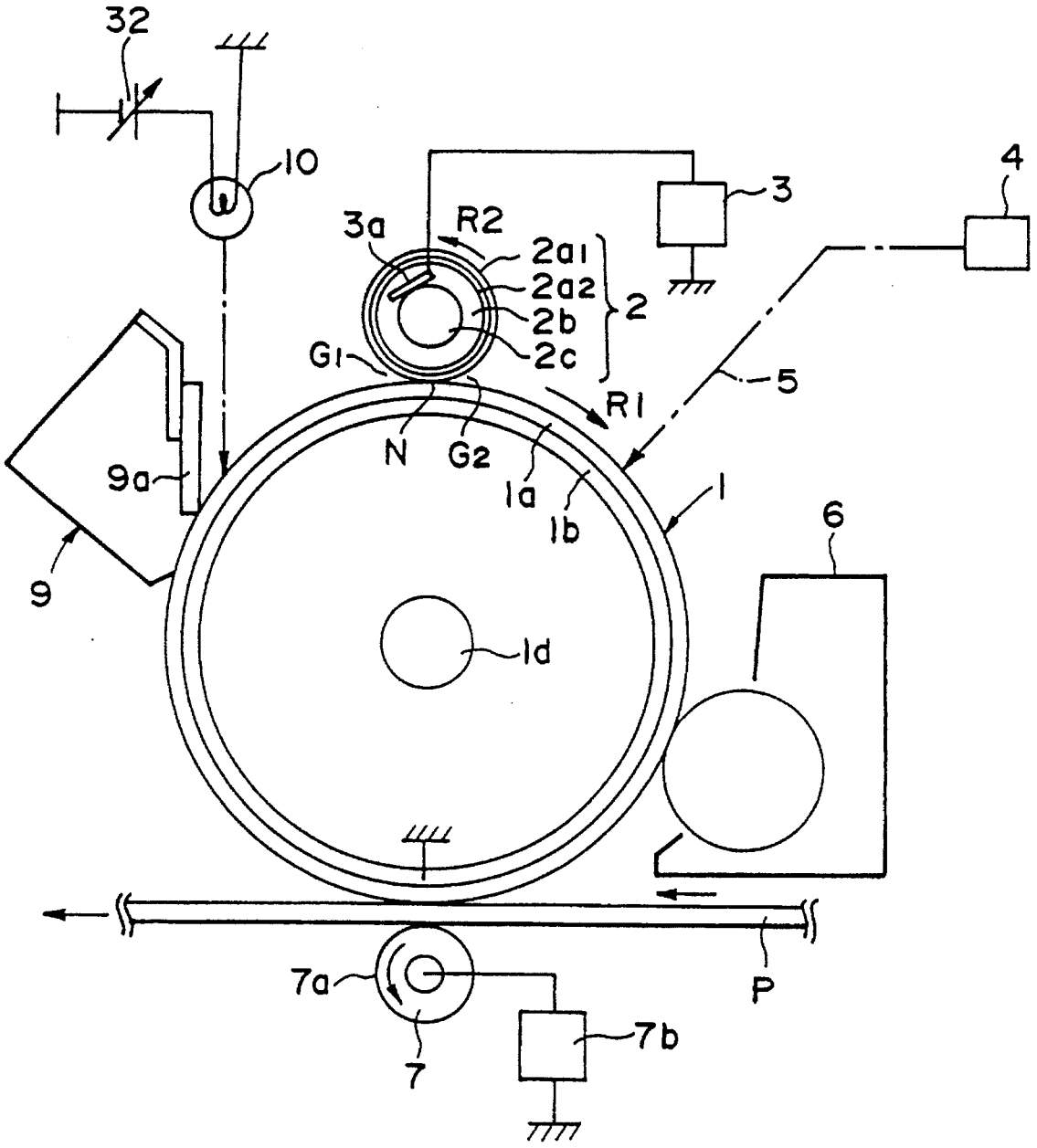
FIG. 18 is a sectional view of an image forming apparatus according to embodiment 4 of the present invention.
Figure 19:
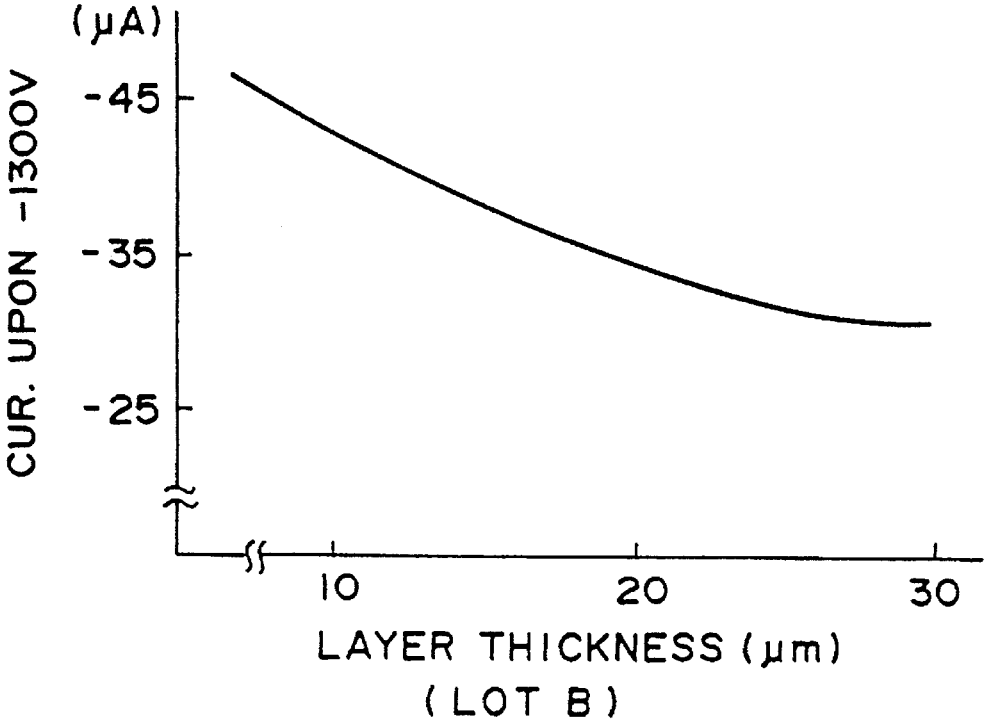
FIG. 19 shows a relation between a thickness of the photosensitive layer of a general photosensitive member and a current upon −1300 V application.
Figure 20:
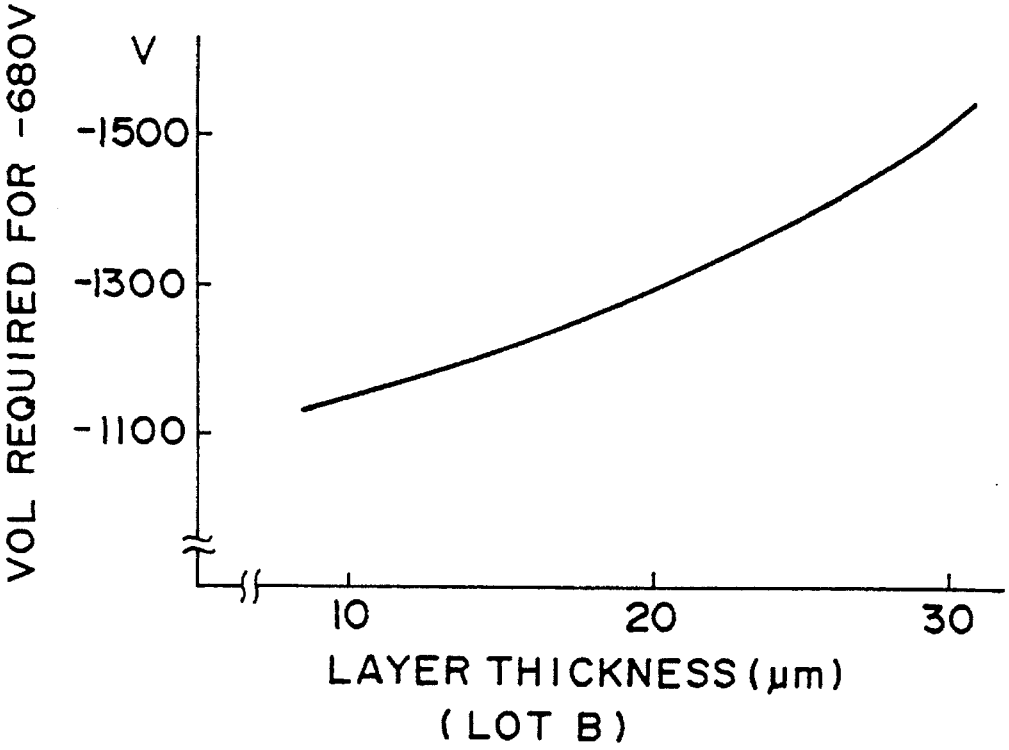
FIG. 20 shows a relation between a thickness of the photosensitive layer in the general photosensitive member and an application voltage necessary for providing the constant drum potential (−680 V).

In this embodiment, as shown in FIG. 16, the length L1 of the reflection portion 31 of the reflection member for improving the charging uniformity is made variable, so that the nip exposure amount to the first gap surface $G_1$ is made variable. FIG. 17 shows a relation between the length of the reflection portion and the current through the charging member upon application of constant voltage (−1300 V) to the charging member. Similarly to embodiment, L1 is set such that the current through the charging member is the same (−35 μA) for each photosensitive member. By doing so, the initial current and drum potential of a new photosensitive member can be made to be I=−35±0.5 μA, $V_D$=−680±10 V.

In this embodiment, there is no need of using transparent material such as a filter, and therefore, the control is simple.

In place of changing the length of the reflection portion, the angle of the reflection portion may be changed, or the reflectance of the reflection portion may be changed. These modification provide the similar advantages.

In another modification, the reflection member is made light transmissive, and the light transmitted through the reflection member and the light reflected by the reflection member among the light rays emitted by the pre-exposure device may be incident on the photosensitive member.

Embodiment 4

The description will be made as to a further embodiment of the changing means for changing the light quantity incident of the photosensitive member.

In this embodiment, in order to adjust the pre-exposure amount by the light incident on the photosensitive member, the turn on voltage 32 of the pre-exposure lamp 10 is made variable in accordance with the photosensitive property of the photosensitive member used, thus permitting control of the exposure amount of the surface of the photosensitive member.

The other structures and operations of the electrophotographic apparatus are the same as in embodiment, and therefore, the description will be omitted.

In this embodiment, the initial current and potential of the photosensitive member are converged to I=−35±0.5 μA, $V_D$=−680±10 V.

This embodiment is effective irrespective of the presence or absence of the reflection member for improving the charging property.

In this embodiment, only electrical control is used without the use of additional members, and the structure is simple.

The forgoing embodiments may be used in combination.

In embodiments 1–4, the use is made with a photosensitive member having a diameter of 30 mm, and a length of 320 mm, which was rotated at a process speed of 100 mm/sec.

Figure 21:
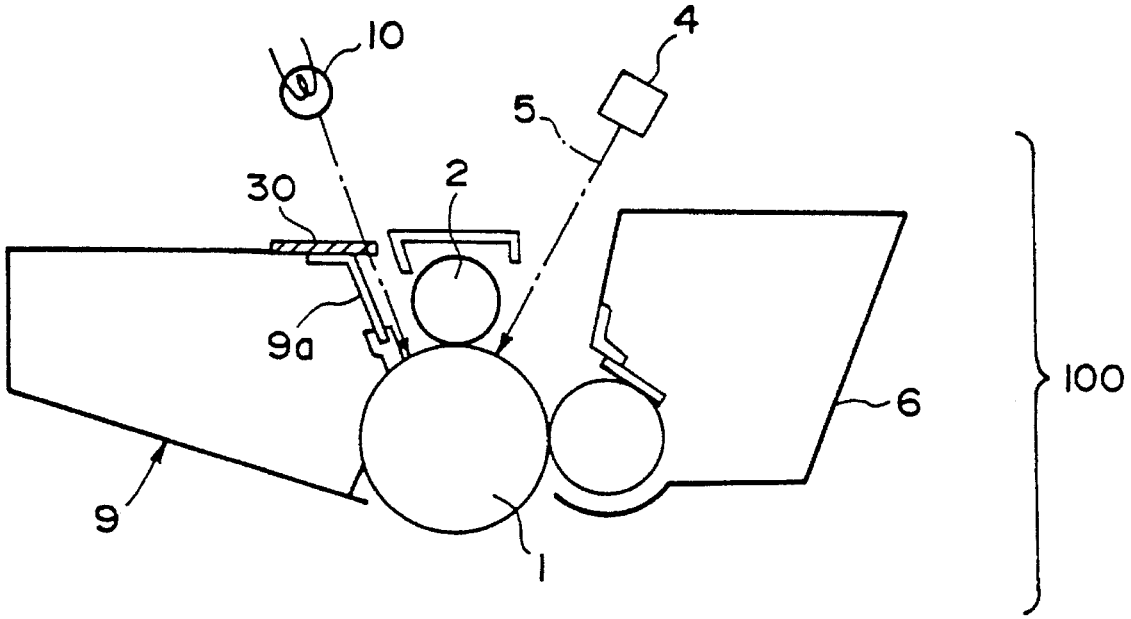
FIG. 21 is an illustration of a process cartridge detachably mountable relative to an image forming apparatus, according to an embodiment of the present invention.

FIG. 21 shows an example, wherein a filter having a light transmittance of 70% as the changing means 30 is press-contacted to a top surface of the cleaning device 9, wherein the entrance amount of the filter is changeable. The changing means, the photosensitive member, the charging member, the cleaning device, and the developing device are constituted into a process cartridge 100 as an unit. The process cartridge 100 is detachably mountable relative to the electrophotographic apparatus. By doing so, even if the photosensitive member is damaged, or the service life thereof is reached, the proper images can be produced by simply replace the cartridge without adjustment of the main assembly. In place of making variable the entering amount, the light transmittance of the filter may be changed in accordance with the kind of the photosensitive member in the cartridge. It is a possible alternative to provide two kinds of cartridges, one with the filter and the other without the filter. The process cartridge may be provided with a reflection member as described in embodiment 3, and the structure of the reflection member may be changed in accordance with the photosensitive property of the photosensitive member.

In this embodiment, the changing means, the photosensitive member, the charging member, the cleaning device, and developing device or the like are integral as an unit cartridge. However, the same advantageous effects can be provided if the at least the changing means and the photosensitive member are contained in the cartridge. Preferably, the cartridge comprises at least one of the photosensitive member, the charging member, the cleaning device and the developing device.

In all of the embodiments, when the photosensitive member is changed with a fresh one, the light quantity incident on the photosensitive member may be changed in accordance with the property of the fresh photosensitive member by using filters, entering amount, reflection member of the filter, the reflection property of the reflection member, the application voltage for the pre-exposure lamp.

When the photosensitive member is exchanged, the kind of filter, entering amount of the filter, the reflection property of reflection member, the application voltage for the pre-exposure lamp may be selected on an operation panel or the like on the electrophotographic apparatus in accordance with the property of the new photosensitive member determined beforehand, by the user or serviceman.

When the photosensitive member is in the process cartridge, the kind of the filter, the entrance amount of the filter, the reflection property of the reflection member is determined preferably beforehand, in accordance with the property of the new photosensitive member. By doing so, the user does not need to input the kind of the filter, entering amount of the filter, reflection property of reflection member for each exchange of the process cartridge.

In all of the foregoing embodiments, in order to discriminated the thickness of the photosensitive layer, the constant voltage control is carried out with a predetermined voltage to the contact charging member, and the current flowing through the contact charging member is detected. In another alternative, a constant current control is effected to the contact charging member with a predetermined current, and the voltage inputted to the contact charging member may be detected. In a further alternative, the charging member may be subjected to a constant current control during image formation.

While the invention has been described with reference to the structures disclosed herein, it is not confined to the details set forth and this application is intended to cover such modifications or changes as may come within the purpose of the improvements or the scope of the following claims.

What is claimed is:

1. An electrophotographic apparatus comprising:

an electrophotographic photosensitive member;

a charging member contactable to said photosensitive member for charging said photosensitive member at a charging position;

exposure means for exposing said photosensitive member to electrically discharging said photosensitive member, wherein when a region of said photosensitive member discharged by said exposure means is at said charging position, a voltage-current characteristic between said charging member and said photosensitive member is detected;

changing means for changing an incident light quantity to said photosensitive member from said exposure means.

2. An apparatus according to claim 1, wherein the said voltage-current characteristic is a current through said charging member when constant voltage control is effected to said charging member with a predetermined voltage.

3. An apparatus according to claim 1, wherein said changing means changes said incident light quantity in accordance with a photosensitive property of said photosensitive member.

4. An apparatus according to claim 2, wherein said changing means changes the incident light quantity to said photosensitive member in accordance with the current when the incident light quantity is constant for a plurality of photosensitive members.

5. An apparatus according to claim 1 or 3, wherein said changing means changes the voltage applied to said exposure means.

6. An apparatus according to claim 1 or 3, wherein said changing means is provided with a light transmission member in an optical path from said exposure means to said photosensitive member.

7. An apparatus according to claim 6, wherein said light transmission member is movable such that an entering amount thereof into an optical path from said light source to said photosensitive member.

8. An apparatus according to claim 1, wherein a gap of a distance between said charging member and said photosensitive member decreasing with movement of said photosensitive member, and said exposure means exposes said photosensitive member at the gap, and said changing means changes a light quantity incident on the gap region corresponding to the gap.

9. An apparatus according to claim 8, wherein said changing means is provided with a reflection member for reflecting the light emitted from said exposure means.

10. An apparatus according to claim 9, wherein said changing means changes the voltage applied to said exposure means.

11. An apparatus according to claim 9, wherein said changing means is provided with a light transmission member in an optical path from said exposure means to said photosensitive member.

12. An apparatus according to claim 11, wherein said light transmission member is movable to permit change of the entering amount into an optical path from said exposure means to said photosensitive member.

13. An apparatus according to claim 9, wherein an area, or light reflection angle, or light reflectance of light reflection surface is changeable.

14. An apparatus according to claim 1, wherein the charging power of said charging member is determined on the basis of the voltage-current characteristic of said charging member to form an image of said photosensitive member.

15. An apparatus according to claim 1 or 14, further comprising second exposure means for exposing said photosensitive member, and the light quantity emitted from the exposure means is determined on the basis of said voltage-current characteristic.

16. An electrophotographic apparatus comprising:

electrophotographic photosensitive member;

a charging member contactable to said photosensitive member for charging said photosensitive member at charging position;

exposure means for exposing said photosensitive member to electrically discharging said photosensitive member, wherein when a region of said photosensitive member discharged by said exposure means is at said charging position, a voltage-current characteristic between said charging member and said photosensitive member is detected;

wherein incident light quantity from said exposure means to said photosensitive member is determined in accordance with the photosensitive property of said photosensitive member in said device.

17. An apparatus according to claim 16, wherein said voltage-current characteristic is a current through said charging member when a constant voltage control is effected to said charging member with a predetermined voltage.

18. An apparatus according to claim 16, further comprising a process unit detachably mountable to a main assembly of said device, and said photosensitive member is provided in said process unit, and said exposure means is provided in said main assembly of said device.

19. An apparatus according to claim 18, wherein a ratio of said incident light quantity to emergent light quantity from said exposure means is set in accordance with a photosensitive property of said photosensitive member in said process unit.

20. An apparatus according to claim 19, wherein whether a light transmission member is provided in an optical path from said exposure means to said photosensitive member is determined in accordance with a photosensitive property of said photosensitive member in said process unit.

21. An apparatus according to claim 19, wherein said process unit is provided with a light transmission member in an optical path from said exposure means to said photosensitive member, and a light transmittance of said light transmission member is set in accordance with a photosensitive property of said photosensitive member in said process unit.

22. An apparatus according to claim 19, wherein said process unit is provided with a light transmission member in an optical path from said exposure means to said photosensitive member, and an entering amount into said optical path is set in accordance with a photosensitive property of said photosensitive member in said process unit.

23. An apparatus according to claim 19, wherein a gap of a distance between said charging member and said photosensitive member decreasing with movement of said photosensitive member, and said process unit comprises a reflection member for reflecting the light emitted from said exposure means to exposure a region of said photosensitive member corresponding to the gap, and area or light reflection angle or light reflectance of a light reflection surface of said reflection member is determined in accordance with the process unit to be mounted to the main assembly.

24. An apparatus according to claim 18, wherein the charging power of said charging member is determined on the basis of the voltage-current characteristic of said charging member to form an image of said photosensitive member.

25. An apparatus according to claim 18 or 24, further comprising second exposure means for exposing said photosensitive member, and the light quantity emitted from the exposure means is determined on the basis of said voltage-current characteristic.

26. An apparatus according to any one of claims 16–24, wherein said process unit includes at least one of said charging member, said photosensitive member, developing device for developing an electrostatic image and a cleaning device for cleaning said photosensitive member.

* * * * *

UNITED STATES PATENT AND TRADEMARK OFFICE

CERTIFICATE OF CORRECTION

PATENT NO. : 5,583,616

DATED : December 10, 1996

INVENTOR(S) : Takeo Yamamoto, et al.

It is certified that error appears in the above-indentified patent and that said Letters Patent is hereby corrected as shown below:

COLUMN 1

Line 56, delete "therefore";
Line 57, "member" should read --members--; and
Line 59, "be to" should read --to be--.

COLUMN 2

Line 10, "invention" should read --description of the--;
Line 25, "gap gaps. Gap" should read --gap--;
Line 26, "FIG.6,(a)" should read --FIGS.6(a) and 6(b)-- and "illustates" should read --illustrate--;
Line 31, "voltage. Corrected" should read --voltage and corrected--; and
Line 57, "to" should read --to the--.

COLUMN 3

Line 11, "Image" should read --The image--; and
Line 29, "$2_1$" should read --$2a_1$--.

UNITED STATES PATENT AND TRADEMARK OFFICE

CERTIFICATE OF CORRECTION

PATENT NO. : 5,583,616

DATED : December 10, 1996

INVENTORS : Takeo Yamamoto, et al.

It is certified that error appears in the above-identified patent and that said Letters Patent is hereby corrected as shown below:

COLUMN 5

Line 44, "KOcharge" should read --charge--;
Line 47, "is" should read --are--;
Line 55, "renewal" should read --renewed--; and
Line 64, "operativity" should read --operability--.

COLUMN 7

Line 3, "z=8" should read --Z=8--;
Line 12, "z." should read --Z.--;
Line 13, "curve" should read --curves--; and
Line 55, "tol/D." should read --to 1/D.--.

COLUMN 9

Line 49, delete "actually";
Line 56, "-38-42" should read ---38--42--; and
Line 59, "large," should read --larger,--.

UNITED STATES PATENT AND TRADEMARK OFFICE

CERTIFICATE OF CORRECTION

PATENT NO. : 5,583,616

DATED : December 10, 1996

INVENTOR(S) : Takeo Yamamoto, et al.

It is certified that error appears in the above-indentified patent and that said Letters Patent is hereby corrected as shown below:

COLUMN 10

Line 7, "sage" should read --stage--; and
Line 67, "with" should read --of--.

COLUMN 11

Line 12, "embodiment," should read --embodiment 2,--;
Line 16, "$V_{D=-}$" should read --$V_D$=- --;
Line 23, modification" should read --modifications-- and "the" should be deleted; and
Line 67, "replace" should read --replacing--.

Signed and Sealed this

Eighth Day of July, 1997

Bruce Lehman

*Attest:*

BRUCE LEHMAN

*Attesting Officer*

*Commissioner of Patents and Trademarks*